US012320569B2

(12) United States Patent
Welch et al.

(10) Patent No.: US 12,320,569 B2
(45) Date of Patent: Jun. 3, 2025

(54) CLIMATE CONTROL SYSTEMS HAVING EJECTOR COOLING FOR USE WITH MODERATE TO HIGH GLIDE WORKING FLUIDS AND METHODS FOR OPERATION THEREOF

(71) Applicant: Copeland LP, Sidney, OH (US)

(72) Inventors: Andrew M. Welch, Franklin, OH (US); Daniel J. Rice, Sidney, OH (US)

(73) Assignee: Copeland LP, Sidney, OH (US)

( * ) Notice: Subject to any disclaimer, the term of this patent is extended or adjusted under 35 U.S.C. 154(b) by 258 days.

(21) Appl. No.: 17/989,271

(22) Filed: Nov. 17, 2022

(65) Prior Publication Data

US 2024/0167732 A1 May 23, 2024

(51) Int. Cl.
*F25B 9/00* (2006.01)
*F25B 13/00* (2006.01)
(Continued)

(52) U.S. Cl.
CPC ..... *F25B 9/006* (2013.01); *F25B 13/00* (2013.01); *F25B 40/00* (2013.01); *F25B 41/26* (2021.01);
(Continued)

(58) Field of Classification Search
CPC .. F25B 9/006; F25B 9/08; F25B 41/26; F25B 13/00; F25B 40/00; F25B 2313/02742; F25B 2341/001; F25B 2341/0011
See application file for complete search history.

(56) References Cited

U.S. PATENT DOCUMENTS 4,788,352 A 11/1988 Smutny
4,840,042 A 6/1989 Ikoma et al.
(Continued)

FOREIGN PATENT DOCUMENTS

CN 113280522 A 8/2021
EP EP-3246637 B1 6/2021
(Continued)

OTHER PUBLICATIONS

English translation of Oh et al. (KR-20210000920-A) (Year: 2021).*
(Continued)

*Primary Examiner* — Miguel A Diaz
(74) *Attorney, Agent, or Firm* — Harness, Dickey & Pierce, P.L.C.

(57) ABSTRACT

Climate control systems, like reversible heat pumps, circulate a working fluid having moderate to high glide with first and second refrigerants having a difference in boiling points ≥about 10° F. (1 atm.). The system includes a gas-liquid separation vessel, a compressor, a first heat exchanger disposed downstream of the compressor that generates a first multiphase or liquid working fluid stream, an expansion device, a second heat exchanger that receives and at least partially vaporizes a reduced pressure stream from the expansion device to generate a second multiphase or vapor working fluid stream; an ejector component disposed downstream of the first and second heat exchangers that receives and mixes the first stream and the second stream to generate a third multiphasic fluid stream that is directed to the gas-liquid separation vessel; and a fluid conduit for circulating the working fluid. Methods of operating such climate control systems are also provided.

17 Claims, 3 Drawing Sheets

Figure 1:
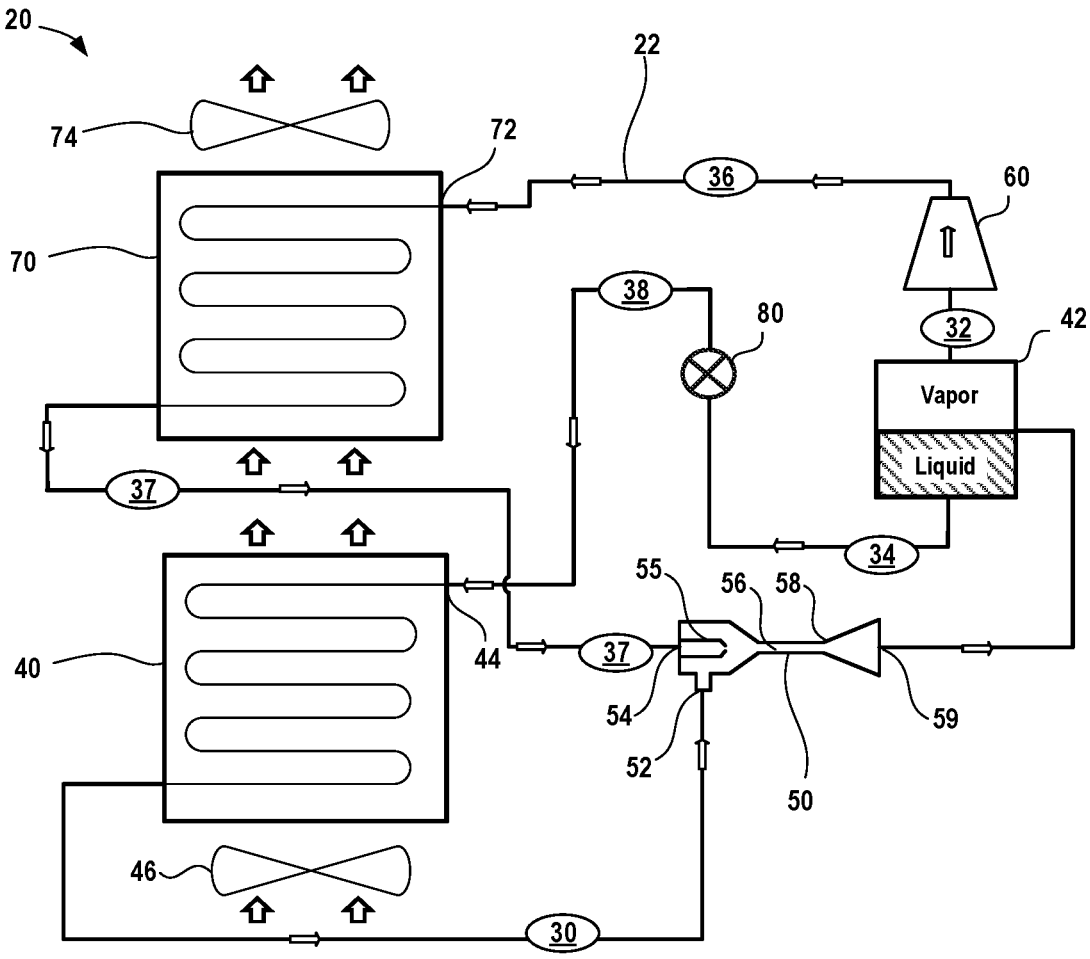

(51) Int. Cl.
*F25B 40/00* (2006.01)
*F25B 41/26* (2021.01)

(52) U.S. Cl.
CPC ..... *F25B 2313/02742* (2013.01); *F25B 2341/001* (2013.01); *F25B 2400/23* (2013.01)

(56) References Cited

U.S. PATENT DOCUMENTS

| | | | | |
|---|---|---|---|---|
| 4,843,837 | A | 7/1989 | Ogawa et al. | |
| 4,981,023 | A | 1/1991 | Krishnakumar et al. | |
| 5,056,329 | A | 10/1991 | Wilkinson | |
| 5,848,537 | A | 12/1998 | Biancardi et al. | |
| 6,675,609 | B2 | 1/2004 | Takeuchi et al. | |
| 6,862,897 | B2 | 3/2005 | Makida et al. | |
| 6,973,804 | B2 | 12/2005 | Horiuchi et al. | |
| 8,444,874 | B2 | 5/2013 | Singh et al. | |
| 8,534,080 | B2 | 9/2013 | Perti | |
| 8,671,703 | B2 | 3/2014 | Mitra et al. | |
| 9,200,820 | B2 | 12/2015 | Okazaki et al. | |
| 9,207,004 | B2 | 12/2015 | Higashiiue et al. | |
| 9,453,668 | B2 | 9/2016 | Higashiiue et al. | |
| 10,101,059 | B2 | 10/2018 | Ma et al. | |
| 10,197,316 | B2 | 2/2019 | De Larminat et al. | |
| 10,267,542 | B2 | 4/2019 | Mahmoud et al. | |
| 10,400,149 | B2 | 9/2019 | Schultz et al. | |
| 10,443,900 | B2 | 10/2019 | Kujak et al. | |
| 10,823,463 | B2 * | 11/2020 | Liu | F25B 41/20 |
| 11,131,471 | B1 | 9/2021 | Butler et al. | |
| 11,131,474 | B2 | 9/2021 | Butler et al. | |
| 11,215,386 | B2 * | 1/2022 | Hellmann | F25B 43/006 |
| 2001/0009360 | A1 | 7/2001 | Jin | |
| 2002/0124592 | A1 | 9/2002 | Takeuchi et al. | |
| 2003/0068181 | A1 | 4/2003 | Miyata et al. | |
| 2003/0131541 | A1 | 7/2003 | Lee et al. | |
| 2004/0008530 | A1 | 1/2004 | Kitahata et al. | |
| 2004/0025525 | A1 | 2/2004 | Kubo et al. | |
| 2005/0031322 | A1 | 2/2005 | Boyle et al. | |
| 2005/0062448 | A1 | 3/2005 | Oh et al. | |
| 2005/0223722 | A1 | 10/2005 | Yamashita et al. | |
| 2005/0258793 | A1 | 11/2005 | Chin et al. | |
| 2006/0033457 | A1 | 2/2006 | Won et al. | |
| 2010/0199716 | A1 * | 8/2010 | Murakami | F25B 43/00 62/512 |
| 2012/0036854 | A1 | 2/2012 | Vaisman et al. | |
| 2012/0116594 | A1 | 5/2012 | Aidoun et al. | |
| 2017/0045269 | A1 | 2/2017 | Ogata et al. | |
| 2020/0354618 | A1 | 11/2020 | Minor et al. | |
| 2021/0033315 | A1 | 2/2021 | Wallet-Laily et al. | |
| 2021/0270509 | A1 | 9/2021 | Mahmoud et al. | |
| 2022/0082304 | A1 | 3/2022 | Welch et al. | |
| 2023/0130167 | A1 * | 4/2023 | Welch | F25B 9/006 62/238.6 |

FOREIGN PATENT DOCUMENTS

| | | | |
|---|---|---|---|
| JP | 2010048549 | A | 3/2010 |
| KR | 20150124450 | A | 11/2015 |
| KR | 20210000920 | A * | 1/2021 |

OTHER PUBLICATIONS

Wang, F., D.Y. Li, and Y. Zhou. "Analysis for the Ejector Used as Expansion Valve in Vapor Compression Refrigeration Cycle." Applied thermal engineering 96 (2016): 576-582. Web. (Year: 2016).*
Andrew M. Welch et al.; U.S. Appl. No. 17/210,095, filed Mar. 23, 2021, entitled "Heat-Pump System with Multiway Valve"; 73 pages.
Brian R. Butler et al.; U.S. Appl. No. 17/210,160, filed Mar. 23, 2021, entitled "Hybrid Heat-Pump System"; 85 pages.
Andrew M. Welch et al.; U.S. Appl. No. 17/507,403, filed Oct. 21, 2021, entitled "Climate Control Systems for Use With High Glide Working Fluids and Methods for Operation Thereof"; 87 pages.
Di Wu et al.; "Vapor compression heat pumps with pure Low-GWP refrigerants"; Abstract only; Renewable and Sustainable Energy Reviews; 138(2):110571; DOI:10.1016/j.rser.2020.110571; Nov. 2020; 8 pages.
Bo Shen et al.; "Energy and Exergy Analysis of Low-Global Warming Potential Refrigerants as Replacement for R410A in Two-Speed Heat Pumps for Cold Climates"; Abstract only; Energies (Basel), vol. 13, Issue 21, ID: ISSN 1996-1073; Oct. 29, 2020; https://www.osti.gov/biblio/1706632; 3 pages.
2010 ASHRAE Handbook; HVAC Systems and Equipment; Chapter 37 Solar Energy Equipment and Systems; https://handbook.ashrae.org/Print.html?file=https://handbook.ashrae.org/Handbooks/S20/IP/S20_Ch37/S20_ch37_ip.aspx; downloaded Dec. 1, 2021; 44 pages.
V. Popa et al.; "Increasing the Air Source Heat Pump Efficiency at Low Ambient Temperature by Using a Two-Phase Ejector"; The 8th International Conference on Advanced Concepts in Mechanical Engineering; IOP Conf. Series: Materials Science and Engineering 444 (2018) 082010; doi:10.1088/1757-899X/444/8/082010; 8 pages.
6.5 Co-versus Counter-Current Flow; SWEP; https://www.swep.net/refrigerant-handbook/6.-evaporators/asas6/; website accessed Oct. 21, 2021; 4 pages.
Frank B. Biancardi et al.; Investigation into the Fractionation of Refrigerant Blends; Jan. 1996; 232 pages.
Kurt W. Roth et al., Energy Consumption Characteristics of Commercial Building HVAC Systems vol. III: Energy Savings PotentialEnergy Consumption Characteristics of Commercial Building HVAC Systems vol. III: Energy Savings Potential, Jul. 2002, 281 pages.
Toshiba, Perfect Comfort catalog, Daiseikai Air Conditioner, www.toshibaaircon.ru, Aug. 15, 2005, 36 pages.
Valery Krasnoslobodtsev et al., TRIZ Improvement of Rotary Compressor Design, Apr. 2005, 15 pages.
Xing Xu, Investigation of Vapor Injection Heat Pump System with a Flask Tank Utilizing R410A and Low-GWP Refrigerant R32; Nov. 3, 2012; 265 pages.
International Search Report and Written Opinion for PCT/US2023/037181 issued Mar. 12, 2024; 12 pages.

* cited by examiner

CLIMATE CONTROL SYSTEMS HAVING EJECTOR COOLING FOR USE WITH MODERATE TO HIGH GLIDE WORKING FLUIDS AND METHODS FOR OPERATION THEREOF

FIELD

The present disclosure relates to climate control systems, such as heat pumps, having an ejector component and gas-liquid separator for use with moderate to high glide working fluids and methods for operation thereof.

BACKGROUND

This section provides background information related to the present disclosure which is not necessarily prior art.

A conventional thermodynamic climate control system such as, for example, a heat-pump system, a refrigeration system, or an air conditioning system, may include a fluid circuit having a first heat exchanger (e.g., a condenser that facilitates a phase change of refrigerant from gas/vapor phase to a liquid) that is typically located outdoors, a second heat exchanger (e.g., evaporator that facilitates a phase change of refrigerant from liquid to gas/vapor phase) that is typically located indoors or within the environment to be cooled, an expansion device disposed between the first and second heat exchangers, and a compressor that operates via a vapor compression cycle (VCC) to circulate and pressurize a gas/vapor phase refrigerant (and optional lubricant oil) between the first and second heat exchangers (e.g., condenser and evaporator). The compressor is typically a mechanical compressor that serves to pressurize the refrigerant, which can be subsequently condensed and evaporated as it is circulated within the system to transfer heat into or out of the system. In heat pump systems, the roles of the first heat exchanger (e.g., condenser) and the second heat exchanger (e.g., evaporator) may be changed based on whether heating or cooling of a space is being performed.

Efficient and reliable operation of heating and cooling climate control systems can help to reduce energy consumption and potential greenhouse gas emissions associated with use and leakage of certain refrigerants. Refrigeration, air conditioning, and heating applications are under increased regulatory pressure to reduce the global warming potential of the refrigerants they use. For example, in the United States, goals have been set to reduce carbon dioxide ($CO_2$) equivalent emissions by 50% by 2030 and 100% by 2050, such that the direct use of fossil fuels to heat buildings (e.g., furnaces, boilers, and the like) has an obsolescence date set. Heat pumps are the leading technology to take their place in the market. While more heat pumps are needed, the global warming potential (GWP) refrigerants allowed by certain government agencies and regulators (such as the United States Environmental Protection Agency (U.S. E.P.A.), California Air Resources Board (CARB), and the like) is declining, for example, predictions are that future limits on refrigerants will be below 150 GWP.

Refrigerants with GWP values below 150 have higher glide, meaning they are often refrigerant blends that may suffer from fractionation and high glide, which traditionally have been considered problems to be avoided in climate control systems. Many refrigerant blends exhibit temperature glide when they undergo phase changes in both the evaporator and condenser. As noted above, in the evaporator, the refrigerant may evaporate or undergo a phase change from a liquid to a vapor. In the condenser, the refrigerant may condense or undergo a phase change from a vapor to a liquid. Refrigerant blends exhibit temperature glide, because there are multiple refrigerant molecules present with different properties. As these refrigerant blends change phase (evaporate and condense), a change in the refrigerant blend composition is observed due to preferential evaporation or condensation of the more or less volatile refrigerant components (also referred to as high-pressure and low-pressure refrigerants) in the blend of the refrigerants. This process is referred to as blend fractionation.

Thus, it would be desirable to employ climate control systems, including heat pumps, which can successfully employ such environmentally friendly refrigerants with low Global Warming Potential, including those having moderate to high glide or blend fractionation properties.

SUMMARY

This section provides a general summary of the disclosure, and is not a comprehensive disclosure of its full scope or all of its features.

In certain aspects the present disclosure relates to a climate control system that circulates a working fluid comprising a refrigerant blend having moderate to high glide. In certain variations, the climate control system comprises a working fluid comprising a first refrigerant and a second refrigerant, wherein a difference in boiling points between the first refrigerant and the second refrigerant is greater than or equal to about 10° F. at atmospheric pressure. The climate control system also comprises a gas-liquid separation vessel that receives the working fluid and generates a vapor stream and a liquid stream. The climate control system further comprises a compressor that receives the vapor stream from the gas-liquid separation vessel and generates a pressurized vapor stream. A first heat exchanger is disposed downstream of the compressor and receives the pressurized vapor stream to generate a first multiphase or liquid working fluid stream. An expansion device receives the liquid stream from the gas-liquid separation vessel and generates a reduced pressure stream. The climate control system comprises a second heat exchanger that receives the reduced pressure stream from the expansion device and at least partially vaporizes the reduced pressure stream to generate a second multiphase or vapor working fluid stream. An ejector component is disposed downstream of the first heat exchanger and the second heat exchanger that receives the first multiphase or liquid working fluid stream and the second multiphase or vapor working fluid stream to generate a third multiphasic fluid stream that is directed to the gas-liquid separation vessel. The climate control system also includes a fluid conduit for circulating the working fluid and establishing fluid communication between the gas-liquid separation vessel, the compressor, the first heat exchanger, the expansion device, the second heat exchanger, and the ejector component through which the working fluid circulates.

In one aspect, the climate control system further comprises a third heat exchanger disposed downstream of the first heat exchanger and the second heat exchanger that is configured to receive the working fluid from the first heat exchanger in a first flow direction on a first side and direct it to the ejector component and configured to receive the working fluid from the second heat exchanger on a second side in a second flow direction that is opposite to the first flow direction and direct it to the ejector component.

In one aspect, the gas-liquid separation vessel has a volume with an excess capacity and is configured to selectively store at least a portion of the working fluid.

In one aspect, the first refrigerant comprises an ASHRAE class A1 or A2L refrigerant.

In one aspect, the first refrigerant and the second refrigerant are independently selected from the group consisting of: carbon dioxide (R-744), 1,1,1,2-tetrafluoroethane (R134A), R410A (a near-azeotropic mixture of difluoromethane (R-32) and pentafluoroethane (R-125), dimethyl ether (R-E170), propane (R-290), 2,3,3,3,-tetrafluoroprop-1-ene (R-1234yf), cis- and trans-1,3,3,3,-tetrafluoropropene (HFO-1234ye), cis- and trans-1,3,3,3,-tetrafluoroprop-1-ene (R-1234ze), 3,3,3,-trifluoropropene (HFO-1234zf), trifluoro, monochloropropenes (HFO-1233), trans-1-chloro-3,3,3-trifluoropropene (HFO-1233zd(E)), cis-1-chloro-3,3,3-trifluoropropene (HFO-1233zd(Z)), 2-chloro-3,3,3-trifluoropropene (HFO-1233xf), trans-1,1,1,4,4,4-hexafluoro-2-butene (HFO-1336mzz(Z)), cis-1,1,1,4,4,4-hexafluoro-2-butene (HFO-1336mzz(E)), pentafluoropropenes (HFO-1225), 1,1,3,3,3-pentafluoropropene (HFO-1225zc), 1,2,3,3,3-pentafluoropropene (HFO-1225yez), hexafluorobutenes (HFO-1336), cis-1,1,1,4,4,4-hexafluoro-2-butene (HFO-1336mzz(Z)), trans-1,1,1,4,4,4-hexafluoro-2-butene (R1336mzz(E)), trans-1,2-difluoroethene (R-1132(E)), and any isomers or combinations thereof.

In one aspect, the working fluid further comprises a lubricant that is preferentially soluble with the first refrigerant and the climate control system further comprises an oil storage vessel or sump that stores at least a portion of the lubricant in the working fluid.

In one aspect, the climate control system further comprises a reversing valve or a pair of four way valves to enable the climate control system to conduct both heating and cooling.

In one aspect, the ejector component comprises a primary inlet that receives the first multiphase or liquid working fluid stream and a secondary inlet that receives the second multiphase or vapor working fluid stream and the ejector component generates a third multiphasic fluid stream that is directed to the gas-liquid separation vessel.

In one further aspect, the ejector component further comprises a converging nozzle, a mixing region downstream of the converging nozzle, and a diverging nozzle downstream of the mixing region.

In certain other aspects, the present disclosure relates to a climate control reversible heat pump system that circulates a working fluid comprising a refrigerant blend having moderate to high glide. In certain variations, the climate control reversible heat pump system comprises a working fluid comprising a first refrigerant and a second refrigerant, wherein a difference in boiling points between the first refrigerant and the second refrigerant is greater than or equal to about 10° F. at atmospheric pressure. The climate control reversible heat pump system also comprises a gas-liquid separation vessel that receives the working fluid and generates a vapor stream and a liquid stream. A compressor receives the vapor stream from the gas-liquid separation vessel and generates a pressurized vapor stream. The climate control reversible heat pump system also comprises an expansion device that receives the liquid stream from the gas-liquid separation vessel and generates a reduced pressure stream. The climate control reversible heat pump system further comprises a reversible heat exchange assembly disposed downstream of the compressor that receives the pressurized vapor stream from the compressor and the reduced pressure stream from the expansion device and generates a first multiphase or liquid working fluid stream and a second multiphase or vapor working fluid stream. The reversible heat exchange assembly comprises a first heat exchanger, a first four-way valve disposed between the compressor and the first heat exchanger, a second heat exchanger, and a second four-way valve disposed between the first heat exchanger and the second heat exchanger. The climate control reversible heat pump system also comprises an ejector component comprising a primary inlet and a secondary inlet and that is disposed downstream of the reversible heat exchange assembly that receives the first multiphase or liquid working fluid stream in the primary inlet and the second multiphase or vapor working fluid stream in the secondary inlet to generate a third multiphasic fluid stream that is directed to the gas-liquid separation vessel. A fluid conduit circulates the working fluid and establishing fluid communication between the gas-liquid separation vessel, the compressor, reversible heat exchange assembly, the expansion device, and the ejector component through which the working fluid circulates.

In one aspect, in a first operational mode the first heat exchanger is configured to receive the pressurized vapor stream to generate the first multiphase or liquid working fluid stream and the second heat exchanger is configured to receive and at least partially vaporize the reduced pressure stream from the expansion device to generate the second multiphase or vapor working fluid stream. In a second operational mode, the first heat exchanger is configured to receive and at least partially vaporize the reduced pressure stream from the expansion device to generate the second multiphase or vapor working fluid stream and the second heat exchanger is configured to receive the pressurized vapor stream to generate the first multiphase or liquid working fluid stream.

In one aspect, the reversible heat exchange assembly further comprises a third heat exchanger disposed downstream of the first heat exchanger and the second heat exchanger that is configured to receive the working fluid from the first heat exchanger in a first flow direction on a first side and direct it to the second four-way valve and the ejector component. The third heat exchanger is configured to receive the working fluid from the second heat exchanger on a second side in a second flow direction that is opposite to the first flow direction and direct it to the second four-way valve and the ejector component.

In one aspect, the gas-liquid separation vessel has a volume with an excess capacity and is configured to selectively store at least a portion of the working fluid.

In one aspect, the first refrigerant and the second refrigerant are independently selected from the group consisting of: carbon dioxide (R-744), 1,1,1,2-tetrafluoroethane (R134A), R410A (a near-azeotropic mixture of difluoromethane (R-32) and pentafluoroethane (R-125), dimethyl ether (R-E170), propane (R-290), 2,3,3,3,-tetrafluoroprop-1-ene (R-1234yf), cis- and trans-1,3,3,3,-tetrafluoropropene (HFO-1234ye), cis- and trans-1,3,3,3,-tetrafluoroprop-1-ene (R-1234ze), 3,3,3,-trifluoropropene (HFO-1234zf), trifluoro, monochloropropenes (HFO-1233), trans-1-chloro-3,3,3-trifluoropropene (HFO-1233zd(E)), cis-1-chloro-3,3,3-trifluoropropene (HFO-1233zd(Z)), 2-chloro-3,3,3-trifluoropropene (HFO-1233xf), trans-1,1,1,4,4,4-hexafluoro-2-butene (HFO-1336mzz(Z)), cis-1,1,1,4,4,4-hexafluoro-2-butene (HFO-1336mzz(E)), pentafluoropropenes (HFO-1225), 1,1,3,3,3-pentafluoropropene (HFO-1225zc), 1,2,3,3,3-pentafluoropropene (HFO-1225yez), hexafluorobutenes (HFO-1336), cis-1,1,1,4,4,4-hexafluoro-2-butene (HFO-1336mzz(Z)), trans-1,1,1,4,4,4-hexafluoro-2-butene (R1336mzz(E)), trans-1,2-difluoroethene (R-1132(E)), and any isomers or combinations thereof.

In certain aspects the present disclosure further relates to a method for operating a climate control system that circulates a working fluid comprising a refrigerant blend having moderate to high glide. The method optionally comprises pressurizing a working fluid vapor by passing it through a compressor in a fluid conduit. The working fluid comprises the refrigerant blend that comprises a first refrigerant and a second refrigerant, where a difference in boiling points between the first refrigerant and the second refrigerant is greater than or equal to about 10° F. at atmospheric pressure. The method also comprises condensing at least a portion of the working fluid in a first heat exchanger disposed downstream of the compressor to form a condensed stream that is delivered to a primary inlet of an ejector component. At least a portion of the working fluid is evaporated in a second heat exchanger to form a vaporized stream that is delivered to a secondary inlet of the ejector component. The condensed stream and the vaporized stream are mixed in an ejector component to form a mixed stream that exits the ejector component. The method also comprises passing the mixed stream into a gas-liquid separation vessel disposed downstream of the ejector component and upstream of the compressor and an expansion device that separates the working fluid into a vapor stream that is directed to the compressor and a liquid stream that is directed towards the expansion device. The pressure of the working fluid is reduced by passing through the expansion device and delivering it to the second heat exchanger.

In one aspect, the method comprises further comprising storing a portion of the first refrigerant and/or the second refrigerant in the gas-liquid separation vessel to modulate cooling capacity of the climate control system.

In one aspect, a first temperature range of the refrigerant blend in the first heat exchanger is operated to be greater than or equal to about 66% to less than or equal to about 150% of a second temperature range of air in the first heat exchanger or the second heat exchanger.

In one aspect, the fluid conduit further comprises a third heat exchanger disposed downstream of the first heat exchanger and downstream of the second heat exchanger. The method further comprises passing the working fluid from the first heat exchanger through a first side of the third heat exchanger in a first flow direction and directing it to the ejector component and passing the working fluid from the second heat exchanger in a second flow direction opposite to the first flow direction to transfer heat therebetween and direct it to the ejector component.

In one aspect, the first refrigerant and the second refrigerant are independently selected from the group consisting of: carbon dioxide (R-744), 1,1,1,2-tetrafluoroethane (R134A), R410A (a near-azeotropic mixture of difluoromethane (R-32) and pentafluoroethane (R-125), dimethyl ether (R-E170), propane (R-290), 2,3,3,3,-tetrafluoroprop-1-ene (R-1234yf), cis- and trans-1,3,3,3,-tetrafluoropropene (HFO-1234ye), cis- and trans-1,3,3,3,-tetrafluoroprop-1-ene (R-1234ze), 3,3,3,-trifluoropropene (HFO-1234zf), trifluoro, monochloropropenes (HFO-1233), trans-1-chloro-3,3,3-trifluoropropene (HFO-1233zd(E)), cis-1-chloro-3,3,3-trifluoropropene (HFO-1233zd(Z)), 2-chloro-3,3,3-trifluoropropene (HFO-1233xf), trans-1,1,1,4,4,4-hexafluoro-2-butene (HFO-1336mzz(Z)), cis-1,1,1,4,4,4-hexafluoro-2-butene (HFO-1336mzz(E)), pentafluoropropenes (HFO-1225), 1,1,3,3,3-pentafluoropropene (HFO-1225zc), 1,2,3,3,3-pentafluoropropene (HFO-1225yez), hexafluorobutenes (HFO-1336), cis-1,1,1,4,4,4-hexafluoro-2-butene (HFO-1336mzz(Z)), trans-1,1,1,4,4,4-hexafluoro-2-butene (R1336mzz(E)), trans-1,2-difluoroethene (R-1132(E)), and any isomers or combinations thereof.

In one aspect, the condensing comprises partially condensing a portion of the working fluid in the first heat exchanger disposed downstream of the compressor to form the condensed stream as a multiphasic condensed stream that is directed to a primary inlet of the ejector component. Further, the evaporating comprises partially evaporating a portion of the working fluid in a second heat exchanger disposed downstream of the expansion device to form the vaporized stream as a multiphasic vaporized stream that is directed to a secondary inlet of the ejector component. The working fluid comprises the refrigerant blend having moderate to high glide that comprises a first refrigerant and a second refrigerant, wherein a difference in boiling points between the first refrigerant and the second refrigerant is greater than or equal to about 25° F. at atmospheric pressure.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 shows a schematic of an example embodiment of a climate control system for circulating a working fluid having blended refrigerants that exhibits moderate to high glide prepared in accordance with certain aspects of the present disclosure that includes a gas-liquid separation vessel and ejector component.

Figure 2:
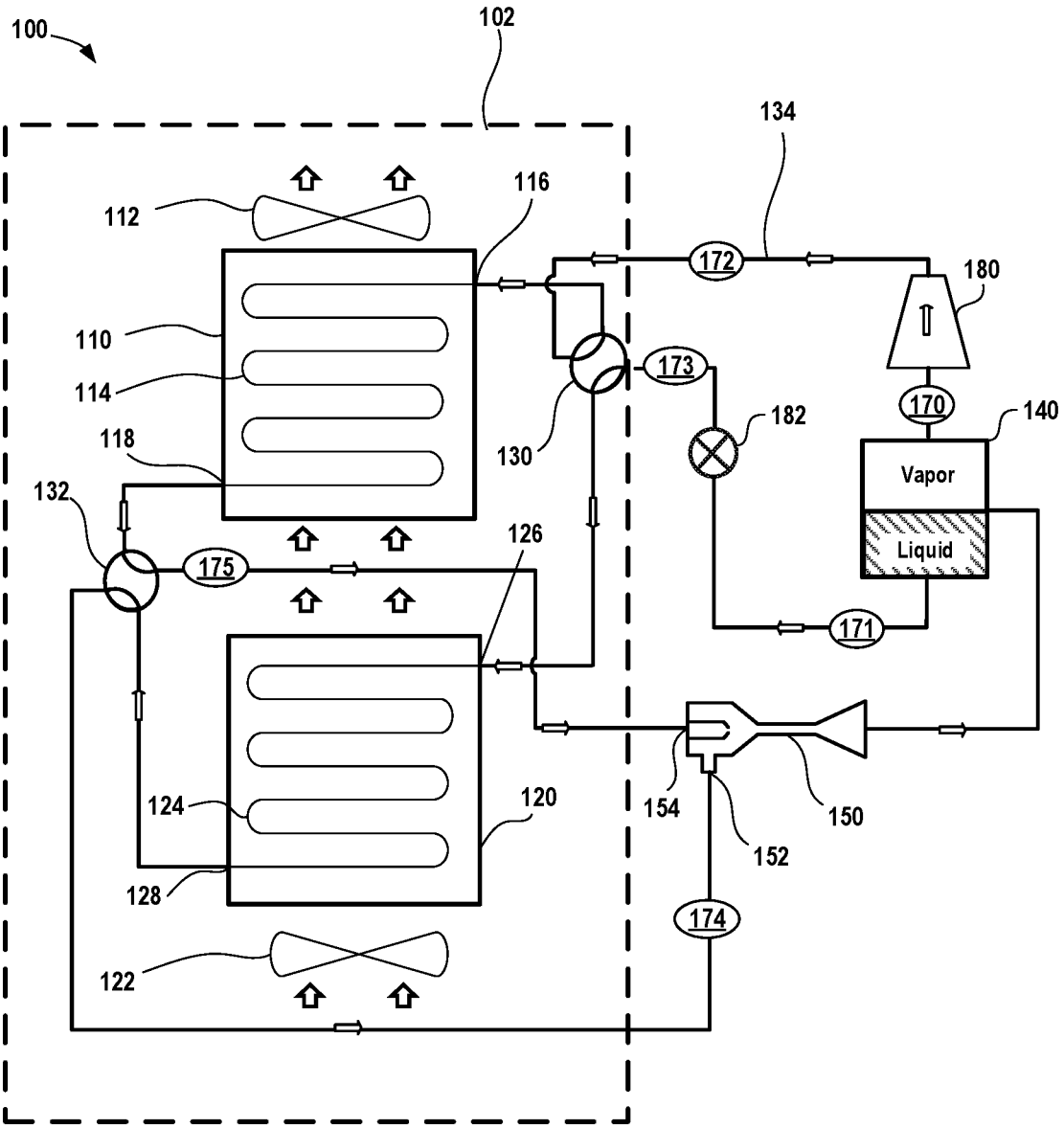

FIG. 2 show a schematic of another example embodiment of a climate control system in the form of a reversible heat pump system for circulating a working fluid having blended refrigerants that exhibits moderate to high glide prepared in accordance with certain aspects of the present disclosure. The reversible heat pump system includes a reversible heat exchanger assembly having a first and a second heat exchanger and two four-way reversing valves. The reversible heat pump system also includes a gas-liquid separation vessel and an ejector component. FIG. 2 shows the reversible heat pump system in a first operational mode, where the first heat exchanger operates as a condenser and the second heat exchanger operates as an evaporator.

Figure 3:
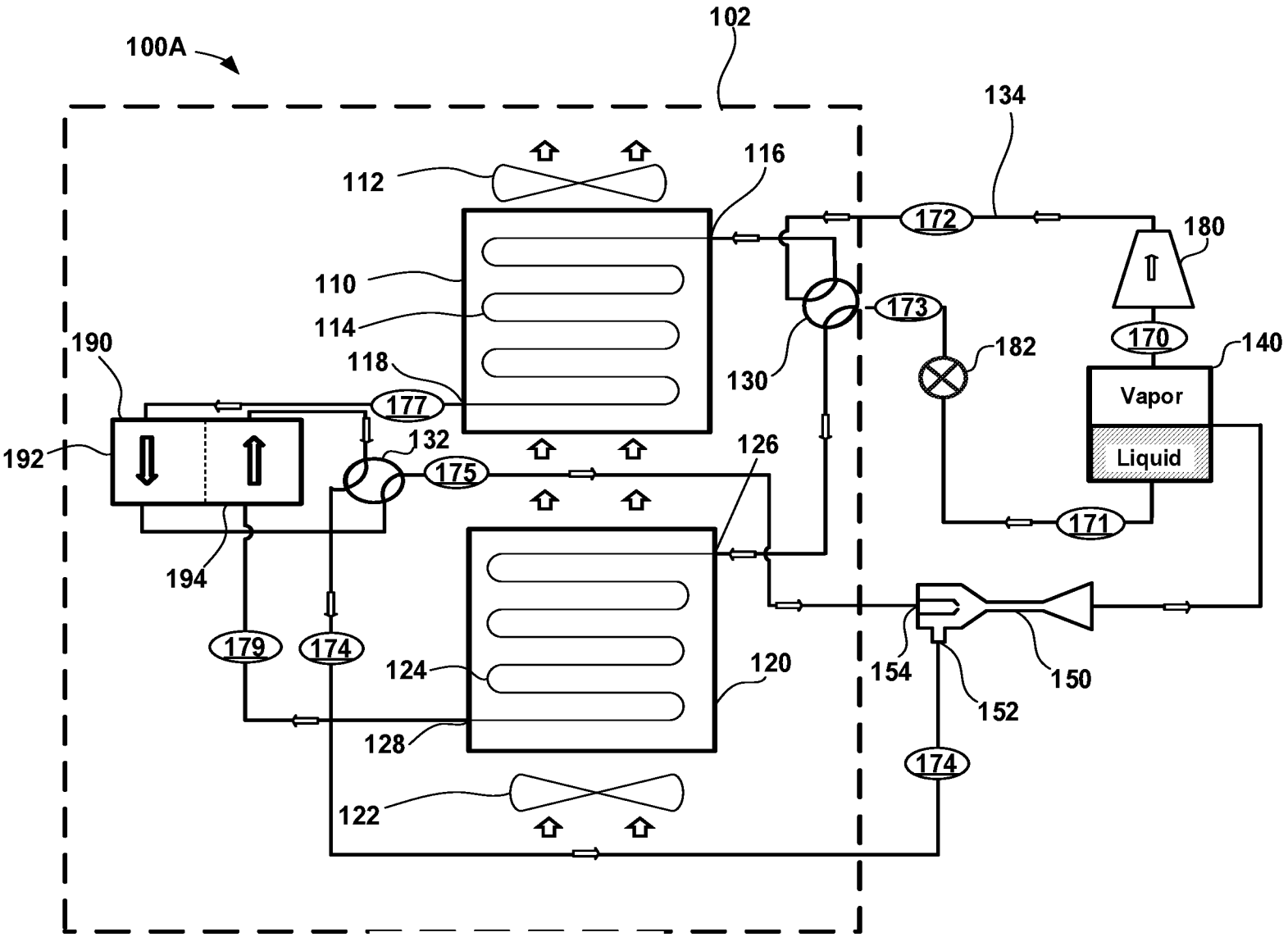

FIG. 3 shows a schematic of yet another example embodiment of a climate control system in the form of a reversible heat pump system for circulating a working fluid having blended refrigerants that exhibits moderate to high glide prepared in accordance with certain aspects of the present disclosure. The reversible heat pump system includes a reversible heat exchanger assembly having first, second, and third heat exchangers and two four-way reversing valves. The reversible heat pump system also includes a gas-liquid separation vessel and an ejector component. FIG. 3 shows the reversible heat pump system in a first operational mode, where the first heat exchanger operates as a condenser and the second heat exchanger operates as an evaporator.

Corresponding reference numerals indicate corresponding parts throughout the several views of the drawings.

DETAILED DESCRIPTION

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended term "comprising," is to be understood as a non-restrictive term used to describe and claim various embodiments set forth herein, in certain aspects, the term may alternatively be understood to instead be a more limiting and restrictive term, such as "consisting of" or "consisting essentially of." Thus, for any given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps. In the case of "consisting of," the alternative embodiment excludes any additional compositions, materials, components, elements, features, integers, operations, and/or process steps, while in the case of "consisting essentially of," any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one step, element, component, region, layer or section from another step, element, component, region, layer or section. Terms such as "first," "second," and other numerical terms when used herein do not imply a sequence or order unless clearly indicated by the context. Thus, a first step, element, component, region, layer or section discussed below could be termed a second step, element, component, region, layer or section without departing from the teachings of the example embodiments.

Spatially or temporally relative terms, such as "before," "after," "inner," "outer," "beneath," "below," "lower," "above," "upper," and the like, may be used herein for ease of description to describe one element or feature's relationship to another element(s) or feature(s) as illustrated in the figures. Spatially or temporally relative terms may be intended to encompass different orientations of the device or system in use or operation in addition to the orientation depicted in the figures.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. For example, "about" may comprise a variation of less than or equal to 5%, optionally less than or equal to 4%, optionally less than or equal to 3%, optionally less than or equal to 2%, optionally less than or equal to 1%, optionally less than or equal to 0.5%, and in certain aspects, optionally less than or equal to 0.1%.

In addition, disclosure of ranges includes disclosure of all values and further divided ranges within the entire range, including endpoints and sub-ranges given for the ranges.

Example embodiments will now be described more fully with reference to the accompanying drawings.

In various aspects, the present disclosure pertains to climate control systems and methods of operating such systems that provide an ability to use working fluids having refrigerant blends including environmentally friendly refrigerants that also exhibit extreme glide during operation. In taking advantage of such extreme glide, the climate control system advantageously can be capacity modulated. In certain aspects of the present disclosure, a "working fluid" composition for a refrigeration system for a heat transfer device, such as a compressor machine, includes a blend of at least two refrigerant(s). The working fluid can be modified in operation by further adding a lubricant having preferential affinity to at least one refrigerant to change the refrigerant blend concentration in circulation in the system. Working fluids for refrigeration systems generally include a minor amount of the lubricant composition, where the lubricant and refrigerant(s) are combined in amounts so that there is relatively more refrigerant than lubricant in the lubricant-refrigerant compositions. Based on the combined weight of lubricant and refrigerant, the refrigerant is greater than or equal to about 50% by weight and the lubricant is less than or equal to about 50% by weight of the combined weight. In various embodiments, the lubricant oil is greater than or equal to about 1 to less than or equal to about 30% by weight of the combined weight of lubricant and high energy refrigerant of from greater than or equal to about 5 to less than or equal to about 20% by weight of the combined weight of the working fluid. Typically, the working fluids include greater than or equal to about 5 to less than or equal to about 20 weight % or optionally greater than or equal to about 5 to less than or equal to about 15 weight % of lubricant with a balance being the refrigerant(s). In the context of the present disclosure, the working fluid may comprise at least two distinct refrigerants that form a blend of refrigerant compositions.

As discussed above, certain refrigerant blends may suffer from fractionation and moderate to high glide, which traditionally have been considered problems to be avoided in climate control systems. Many refrigerant blends exhibit temperature glide when they undergo phase changes in both the evaporator (the refrigerant undergoes a phase change from liquid to vapor) and condenser (undergoes a phase change from vapor to liquid). As these refrigerant blends change phase (evaporate and condense), a change in the refrigerant blend composition is observed due to preferential evaporation or condensation of the more or less volatile refrigerant components (also referred to as high-pressure and low-pressure refrigerants) in the blend of the refrigerants. This process is referred to as blend fractionation.

Thus, a total temperature glide of a refrigerant blend may be defined as a difference in temperature between a saturated vapor temperature and a saturated liquid temperature at a constant pressure. Stated in another way, glide may be considered to be a temperature difference between the starting and ending temperature of a refrigerant phase change within a system at a constant pressure.

In the context of certain aspects of the present technology, counterintuitively, a working fluid is intentionally selected that has a moderate or high glide refrigerant blend. In certain aspects, the refrigerant blend may comprise a first refrigerant with a relatively low normal boiling point (also referred to herein as a high-pressure refrigerant) and a second refrigerant with a relatively high normal boiling point (also referred to herein as a low-pressure refrigerant). In certain aspects, the first refrigerant may have a first (low) boiling point of greater than or equal to about −270° C. to less than or equal to about 8° C. Thus, the low boiling point refrigerant may have a boiling point in a range from hydrogen at −267° C. to R1336mzz(E) at 7.5° C. In certain aspects, the second refrigerant may have a second (high) boiling point of greater than or equal to about −55° C. to less than or equal to about 100° C. For example, the high boiling point refrigerant can range from difluoromethane (R32) at approximately −52° C. to water ($H_2O$) at 100° C. As will be appreciated by those of skill in the art, the refrigerant components are selected to create a blend that meets the goals of the system in the application. A different blend may be selected for cryogenic applications, low temperature refrigeration, medium temperature refrigeration, air conditioning, and different process cooling applications, and the like.

Thus, the working fluid may comprise a first refrigerant and a second refrigerant having a difference in normal boiling points (e.g., ΔT=First Refrigerant Boiling Point ($BP_1$)— Second Refrigerant Boiling Point ($BP_2$)) of greater than or equal to about 10° F. (5.6° C.) at atmospheric pressure, which may be considered to be a moderate glide refrigerant blend. The first refrigerant and a second refrigerant may be chosen for various properties, including respective normal boiling points, glide efficiency, global warming potential, environmental impact, such as polyfluoroalkyl substances (PFAS) impact, capacity, pressure, safety, and the like. In certain aspects, the difference in normal boiling points between the first refrigerant and the second refrigerant provides a high-glide refrigerant blend, where the difference is greater than or equal to about 25° F. (about 14° C.), optionally greater than or equal to about 50° F. (28° C.), optionally greater than or equal to about 75° F. (42° C.), optionally greater than or equal to about 100° F. (55° C.), optionally greater than or equal to about 125° F. (69° C.), and in certain aspects, optionally greater than or equal to about 150° F. (83° C.) at atmospheric pressure.

By way of example, the present disclosure contemplates employing refrigerant blends comprising at least one refrigerant that has a low global warming potential, such as ASHRAE (American Society of Heating, Refrigerating and Air-Conditioning Engineers) classified A1 (no flame propagation/lower toxicity levels) and A2L (mildly flammable/lower flammability than A2 and A3 refrigerants and lower toxicity) refrigerants. Examples of A2L refrigerants include difluoromethane ($CH_2F_2$ or R-32—as used herein, the refrigerants may be interchangeably described by the conventional nomenclature of "R" for refrigerant or their specific chemical class code, like HFC-32) with a global warming potential of about 677, and hydrofluorolefins (HFOs), like 2,3,3,3,-tetrafluoroprop-1-ene (HFO-1234yf or R-1234yf), trans-1,3,3,3,-tetrafluoroprop-1-ene (HFO-1234ze or R-1234ze).

In particular, the heating, ventilation, air conditioning, and refrigeration (HVAC/R) industry has been searching for A1 (non-toxic and non-flammable) refrigerants, including blends with such A1 refrigerants, that have high cooling capacity per displacement, while desirably avoiding supercritical operation and sub-atmospheric pressures in order to enable low-cost compression and piping, while protecting the safety of the equipment operators and users. In certain aspects, the refrigerant blend comprises an A1 refrigerant. As noted above, examples of A1 refrigerants include carbon dioxide (R-744), chlorodifluoromethane (R-22 or $CHClF_2$), 1,1,1,2-tetrafluoroethane (R134A), and R410A (a near-azeotropic mixture of difluoromethane (R-32) and pentafluoroethane (R-125)), and trifluoro, monochloropropenes (R-1233), including cis- and trans-1-chloro-3,3,3-trifluoropropene (HFO-1233zd) isomers (HFO-1233zd(Z) and HFO-1233zd(E)), and hexafluorobutenes (HFO-1336, including HFO-1336mzz(Z), 1336mzz(E)). A2L refrigerants include difluoromethane (R-32) and hydrofluorolefins (HFOs). Many suitable HFO refrigerants are described in U.S. Pat. No. 4,788,352 to Smutny and U.S. Pat. No. 8,444,874 to Singh et al., the relevant portions of which are incorporated herein by reference. The HFOs may include 2,3,3,3,-tetrafluoroprop-1-ene (HFO-1234yf) and trans-1,3,3,3,-tetrafluoroprop-1-ene (HFO-1234ze). Non-limiting suitable examples of specific HFO refrigerants include 3,3,3,-trifluoropropene (HFO-1234zf), HFO-1234 refrigerants like 2,3,3,3,-tetrafluoropropene (HFO-1234yf), 1,2,3,3,-tetrafluoropropene (HFO-1234ze), cis- and trans-1,3,3,3,-tetrafluoropropene (HFO-1234ye), pentafluoropropenes (HFO-1225) such as 1,1,3,3,3, pentafluoropropene (HFO-1225zc), hexafluorobutenes (HFO-1336), such as cis-1,1,1,4,4,4-hexafluoro-2-butene (HFO-1336mzz-Z) and trans-1,1,1,4,4,4-hexafluoro-2-butene (R1336mzz(E)), or those having a hydrogen on the terminal unsaturated carbon such as 1,2,3,3,3, pentafluoropropene (HFO-1225yez), fluorochloropropenes such as trifluoro, monochloropropenes (HFO-1233) like $CF_3CCl{=}CH_2$ (HFO-1233xf) and $CF_3CH{=}CHCl$ (HFO-1233zd) (including trans (E) and cis (Z) isomers (HFO-1233zd(E) and HFO-1233zd(Z)), (E)-1,2-difluoroethene (R-1132(E)), and any combinations thereof. In certain aspects, the HFO refrigerant may be selected from the group consisting of: R-1234yf, R-1234ze, R1233zd(E), R1233zd(Z), R1336mzz(Z), R1336mzz(E), R-1132(E), and combinations thereof.

According to certain variations, at least one refrigerant in the working fluid refrigerant blend used with present technology may comprise a refrigerant selected from the group consisting of: R-744, R-32, R134A, R410A, R-1234yf, R-1234ze, R1233zd(E), R1233zd(Z), R1336mzz(Z), R1336mzz(E), and combinations thereof.

In certain aspects, the first refrigerant and the second refrigerant are independently selected from the group consisting of: carbon dioxide (R-744), difluoromethane (R-32), 1,1,1,2-tetrafluoroethane (R134A), R410A (a near-azeotropic mixture of difluoromethane (R-32) and pentafluoroethane (R-125), dimethyl ether (R-E170), hydrofluorolefins (HFOs), dimethyl ether (R-E170), propane (R-290), and combinations thereof.

The refrigerants may be used in combination with other A1 or A2L refrigerants or yet other refrigerants, such or A3 or B1 or B2 refrigerants, including natural or flammable refrigerants (e.g., dimethyl ether (R-E170), propane ($C_3H_8$ or R-290)).

In certain variations, the first refrigerant is selected from the group consisting of: carbon dioxide (R-744),1,1,1,2-tetrafluoroethane (R134A), R410A (a near-azeotropic mixture of difluoromethane (R-32) and pentafluoroethane (R-125), dimethyl ether (R-E170), difluoromethane (R-32), hydrofluorolefins (HFOs), and combinations thereof, while the second refrigerant is selected from the group consisting of: 2,3,3,3,-tetrafluoroprop-1-ene (R-1234yf), 1,3,3,3,-tetrafluoroprop-1-ene (R-1234ze), 1-chloro-3,3,3-trifluoropropene (HFO-1233zd(E), 1-chloro-3,3,3-trifluoropropene (HFO-1233zd(Z), HFO-1233zd(Z))1,1,1,4,4,4-hexafluoro-2-butene (HFO-1336mzz), and combinations thereof.

In certain aspects, the refrigerant blend includes an A1 refrigerant, such as carbon dioxide (R-744), mixed with at least one other refrigerant. The carbon dioxide refrigerant is desirably used in a sub-critical system design. One example of a suitable, non-limiting refrigerant blend includes $CO_2$ (R-744) as the more volatile, high-pressure refrigerant mixed with R1234ze as the less volatile, low-pressure fluid. In such an example, the refrigerant blend has a first refrigerant comprising $CO_2$ with a normal boiling or triple point/sublimation point (at 1 atmosphere (atm.) of pressure) of approximately −78° C. and a second refrigerant comprising R1234ze with a normal boiling point of approximately −2° C. at 1 atm. of pressure, so that a difference in boiling points is about 76° C.

In another variation, the refrigerant blend may include an A1 refrigerant, such as $CO_2$ (R-744) mixed with a flammable refrigerant (ASHRAE 34 class A3) such as propane ($C_3H_8$ or R-290) or dimethyl ether (R-E170). In this example, the refrigerant blend has a first refrigerant comprising $CO_2$ that subliminates at approximately −78° C. and a second refrigerant comprising R-E170 with a normal boiling point of approximately −24° C., so that a difference in boiling points is about 54° C. or 97° F.

While an amount of refrigerant present in the working fluid may vary at different points in the system and may be based on particular system requirements, in certain variations, the working fluid charged into the system may include a first refrigerant that may be a more volatile, high-pressure refrigerant present at greater than or equal to about 5% by weight to less than or equal to about 95% by weight and the second refrigerant may be a less volatile, low-pressure refrigerant that is present at greater than or equal to about 5% by weight to less than or equal to about 95% by weight based on the combined weight of all refrigerants. In one example, the working fluid does not need to have a large quantity of a fluid with a higher critical temperature, namely the second refrigerant, blended with a first refrigerant, such as $CO_2$ (R-744), to advantageously keep the $CO_2$ out of a transcritical operating regime. In certain variations, the first refrigerant may be a more volatile, high-pressure refrigerant present at greater than or equal to about 50% by weight and the second refrigerant may be a less volatile, low-pressure refrigerant that is present at less than or equal to about 50% by weight based on the combined weight of all refrigerants.

In this manner, fractionation may be a phenomenon that enables a variable blend refrigerant, so that fractionation can be used in the climate control system, for example by use of heat exchangers (e.g., evaporator and condensers) and/or storage vessels to separate streams into different concentrations. Thus, the refrigerant flow may allow only a small portion of a phase change to occur in each heat exchanger. Only a portion of the total glide is experienced in partial phase change. For example, a lower volatility liquid can flow out of the evaporator and be pulled into the ejector by the driving stream with the vapor to be stored in the flash tank and recycled back to the evaporator. In another variation, a high concentration of more volatile, high-pressure gas forms from refrigerant that is not condensed, but is released into the evaporator inlet. In this manner, as will be described in further detail below, the head is reduced and the glide is taken from a portion of the two-phase region.

As will be described in more detail below, refrigeration lubricant oils known to be suitable for use with such refrigerants are contemplated. The working fluid may comprise a synthetic oil. In certain variations, the lubricant oil may comprise a polyvinyl ether (PVE) oil, a polyalphaolefin (PAO), a polyalkylene glycol (PAG), alkylbenzene, mineral oil, or an ester-based oil, such as polyol ester (POE) oil. In certain variations, for example, the lubricant oil may comprise a polyol ester (POE) compound formed from a carboxylic acid and a polyol. In certain variations, such a POE may be formed from a carboxylic acid selected from a group consisting of: n-pentanoic acid, 2-methylbutanoic acid, n-hexanoic acid, n-heptanoic acid, 3,3,5-trimethylhexanoic acid, 2-ethylhexanoic acid, n-octanoic acid, n-nonanoic acid, and isononanoic acid, and combinations thereof and a polyol selected from a group consisting of: pentaerythritol, dipentaerythritol, neopentyl glycol, trimethylpropanol, and combinations thereof. Where carbon dioxide (R-744) is present in the refrigerant blend, in certain variations, the lubricant may comprise a polyol ester oil (POE) oil. For example, one particularly suitable lubricant oil is a polyol ester oil designated 3MAF, which is a reaction product of pentaerythritol (nominally about 78% to 91% and dipentaerythritol (nominally about 9% to 22%)) polyols with carboxylic acids (valeric acid nominally at 29% to 34%, heptanoic acid nominally at 34% to 44%, and 3,5,5-trimethyl hexanoic acid nominally at 22% to 37%).

In various aspects, the climate control systems contemplated by the present disclosure provide the ability to use the extreme glide properties of a refrigerant blend during operation, which allows components to be isolated and stored in a concentrated state, which can then change the concentration of the blend at the compressor suction in order to enable high density gas compression for enhanced capacity and variable density gas compression for system capacity modulation, for example. Additionally, capacity modulation can be achieved by reducing the amount of refrigerant to undergo phase change.

In certain aspects, methods of operating climate control systems may include using such a working fluid comprising at least a first refrigerant and a second distinct refrigerant, where the evaporation and condensation of the refrigerant blend/working fluid is only partial, thus resulting in a specialized vapor compression cooling/heating cycle. For example, using the ejector cycle with a moderate or high glide refrigerant blend allows the evaporator and condenser to operate with a different mixture (by concentration of refrigerants in the working fluid) resulting from fractionation in the flash tank.

A conventional thermodynamic climate control system such as, for example, a heat-pump system, a refrigeration system, or an air conditioning system configured to use a high glide refrigerant blend is contemplated by certain aspects of the present disclosure. In various aspects, the present disclosure pertains to climate control systems used in a wide variety of refrigeration and heat energy transfer applications, in some cases, to industrial or commercial air-conditioning or refrigeration units, e.g., for factories, office buildings, apartment buildings, warehouses, and ice skating rinks, or for retail sale.

By way of example, FIG. 1 shows a schematic of an example of a simplified climate control system 20, such as a refrigeration system, that processes and circulates a working fluid having a composition comprising at least a first refrigerant (A) and a second refrigerant (B) that exhibit moderate or high glide. The capacity of the climate control system 20 may be modulated by changing relative proportions of first refrigerant (A) and second refrigerant (B) in the working fluid blend at different points in the system. Therefore, a resulting density of the compressor suction may be modified by preferentially storing concentrated amounts of first refrigerant (A) or second refrigerant (B) in one or more select regions of the system. In various aspects, the present disclosure provides a vapor compression system that is configured to incompletely evaporate and condense refrigerant(s) in the working fluid.

As discussed above, more than two refrigerants may be present in the working fluid, but for simplicity, two refrigerants are used in this example and a difference in boiling points between the first refrigerant (A) and the second refrigerant (B) is greater than or equal to about 10° F. at atmospheric pressure. The working fluid may also include oil(s) at certain points in the system, as will be described in greater detail below. The term "fluid" as used herein encompasses liquid, gas, and any combinations thereof, including vapor (e.g., a gas phase having aerosolized liquid droplets). The term gas or gas phase as used herein is intended to encompass both vapor and pure gas phases.

The climate control system 20 has a fluid flow path or fluid conduit 22 that establishes fluid communication between the various components, so that the working fluid may circulate in a loop as discussed further herein. First, the working fluid including the first refrigerant (A) and second refrigerant (B) may enter a first heat exchanger, which in the cooling operational mode used by way of example, is in the form of the evaporator 40. The evaporator 40 causes first refrigerant (A) and/or second refrigerant (B) to transform from a portion of the liquid phase to a gas or vapor phase as it exits the evaporator 40, where the cooling effect of endothermic energy absorption occurs. The refrigerant(s) typically evaporate at a lower pressure withdrawing heat from the surrounding zone. Air can flow through the evaporator 40 for heat exchange as shown by arrows, for example, driven by a fan 46, where the air is then cooled. As shown, the air flows in a countercurrent arrangement, although concurrent or other airflow configurations may also be used. The heat exchangers (evaporator 40 and a second heat exchanger in the form of a condenser 70, discussed below) may include concentric, finned tube, brazed plate, plate and frame, microchannel, or other heat exchangers. There may be a single evaporator and condenser or multiple evaporators or condensers in parallel or series configurations. Refrigerant flow therein can be controlled via a capillary tube, thermostatic expansion valve, electric expansion valve, or other methods. In heat pump systems, as will be discussed further below, the roles of the evaporator 40 and the condenser 70 may be changed based on whether heating or cooling of a space is being performed.

The evaporator 40 may be located in a room or space to be cooled by the climate control system 20 or used to cool air flowing into a room or space in which cooling is desired. Thus, the evaporator 40 receives and at least partially vaporizes a low-pressure multiphase working fluid at point 30 and directs the working fluid to a downstream ejector component 50. At point 30 in the fluid conduit 22, the working fluid comprises a combination of both first refrigerant (A) and second refrigerant (B) that are partially or fully in gas phase when the climate control system 20 is operated in a cooling mode. Working fluid at point 30 may be a multiphase composition. As noted above, one aspect of the present technology is that the working fluid having the refrigerant blend with first refrigerant (A) and second refrigerant (B) is only partially evaporated to form a mixture of both gas/vapor and liquid. For example, the first refrigerant (A) may have a lower boiling point and is thus more volatile, so a greater amount of first refrigerant (A) volatizes or evaporates, while second refrigerant (B) has a higher boiling point and thus a lower proportion of second refrigerant (B) evaporates or volatilizes in the working fluid and thus a larger proportion remains in liquid form. In certain aspects, a portion of the first refrigerant (A) may be in gas or vapor form, for example, greater than or equal to about 75% to less than or equal to about 100% by mass, while a remaining percentage of the first refrigerant (A) may be in a liquid phase. The presence of a gas-liquid separator 42 (e.g., flash tank to be described further herein) in the climate control system provides an ability to control how much of a temperature range for the refrigerant blend is being used. By way of example, the vapor quality, or mass fraction of vapor of the working fluid at point 30 that exits the evaporator may be predetermined to be any amount, for example from greater than or equal to about 15% to about 100% vapor quality, optionally about 80% to about 100% vapor quality, by way of non-limiting example, depending on an amount of liquid evaporated.

Thus, the vapor-containing low-pressure multiphase working fluid enters a secondary inlet 52 of the ejector component 50. The ejector component 50 also has a primary inlet 54 that receives a liquid-containing high-pressure multiphase working fluid that exits the condenser 70, as will be described in more detail below. In this manner, the ejector component 50 receives two distinct streams that are blended together. An ejector component 50 may also be referred to as an eductor, venturi, or a jet pump. In certain aspects, the primary inlet 54 of the ejector component 50 serves as the driving or motive flow and the secondary inlet 52 serves as the pulled flow stream.

Ejectors typically use the kinetic energy of one fluid, such as a liquid, a mixture of liquid and vapor, vapor, or gas, to cause another fluid to flow. Ejector components 50 contain at least one nozzle, for example, a driving or converging nozzle 55, as well as having a mixing region 56, and a diverging or diffuser nozzle 58. The converging nozzle 55 converts the pressure energy of the moving stream to a high velocity, for example, exceeding the speed of sound. This high velocity stream can then entrain the suction or pulled flow stream in that enters the mixing region 56 with a reduced diameter. In the mixing region 56 of the body of the ejector component 50, extensive mixing of the motive and suction fluids occurs. The mixed fluid is then converted back from a high velocity mixed stream to an intermediate pressure stream after passing through the diffuser nozzle 58. More specifically, speed of the mixed stream is reduced as it passes through the diffuser nozzle 58 and its pressure is increased prior to exiting an outlet 59. In this manner, the ejector component 50 can reduce or eliminate the need for liquid pumps in the system. Moreover, as will be described below, the ejector component 50 used in combination with a working fluid having a high glide blend of refrigerants can serve to enhance efficiency of the system during operations, for example, to reduce work required of the compressor, as compared to a conventional system.

The ejector component 50 may also include a diverging diffuser nozzle 58 to recover the velocity back into pressure after the mixing of the driving flow from the primary inlet 54 and the pulled flow from the secondary inlet 52. An ejector component 50 may have a configuration where a flow area of each inlet (primary 54 and secondary 52) is selected to minimize the loss of pressure and velocity from its source and a flow area of the outlet 59 is selected to minimize a loss of pressure and velocity as it supplied to the next component in the system. In certain aspects, the ejector component 50 may have a minimum flow area of the nozzle determined by calculation as the maximum area that enables the highest the nozzle velocity with the isentropic expansion of inlet fluid at the full range of operating conditions for its application. In certain aspects, a manufactured ejector component 50 may be an assembly of separately formed parts, for example, a housing that may define a body, the converging nozzle 55, and diffusing nozzle 58. For example, each nozzle (e.g., converging 55 or diffuser 58) may be cast, forged, molded, sintered, or additively printed, for example, of a metal material. The housing is drawn, extruded, rolled and joined, cast, forged, machined, or additively printed, for example, of a metal material. With separate parts for the converging nozzle 55 and the diffuser 58, the housing may then be integrated into one or both of these components. In other variations, the full ejector component 50 and its various subcomponents may be made via a single additive manufacturing/printing process to form a monolithic or integral component.

Assuming that at least a portion of the working fluid in conduit 22 at point 30 exiting the ejector component 50 at outlet 59 includes the second refrigerant (B) in liquid form, the working fluid passes into a gas-liquid separation vessel or flash tank 42 that receives the working fluid and generates a vapor stream 32 and a liquid stream 34. The working fluid at point 30 is thus processed into the ejector component 50 and then into flash tank 42 where it is separated into two distinct streams, a first vapor stream at point 32 and a second liquid stream at point 34. The vapor stream 32 may include gas or vapor phase refrigerants, including substantially more volatile first refrigerant (A) and a portion of the less volatile second refrigerant (B), depending on desired operating conditions. The liquid stream 34 may comprise the second refrigerant (B) in a liquid phase, for example, in certain variations, a majority of the liquid stream 34 may be second refrigerant (B).

The vapor stream 32 passes into a compressor 60 where it is compressed to increase pressure and form a high-pressure vapor or gas stream 36 exiting the compressor 60. The compressor 60 may be a variety of different compressors known in the art. Types of compressors useful for the above application can be classified into two broad categories, both positive displacement and dynamic compressors. Positive displacement compressors increase refrigerant vapor pressure by reducing the volume of the compression chamber through work applied to the compressor's mechanism. Positive displacement compressors include many styles of compressors currently in use, such as reciprocating, rotary (rolling piston, rotary vane, single screw, twin screw), and orbital (scroll or trochoidal). Dynamic compressors increase refrigerant vapor pressure by continuous transfer of kinetic energy to the vapor in a compression mechanism in the form of a rotating member, followed by conversion of this energy into a pressure rise. Centrifugal compressors function based on these principles. Details of the design and function of these compressors for refrigeration applications can be found in the 2010 ASHRAE Handbook, HVAC systems and Equipment, Chapter 37, incorporated herein by reference. In certain variations, the compressor 60 may be a scroll compressor or a reciprocating compressor, by way of example.

A high-pressure or pressurized gas stream 36 exiting the compressor 60 has a pressure that is significantly greater than the pressure of entering vapor stream 32. The mechanical energy required for compressing the vapor and pumping the fluid in the compression mechanism of the compressor is provided by, for example, an electric motor or internal combustion engine. Notably, in certain aspects, the climate control system 20 provides a turndown without requiring traditional compressor modulation techniques by changing a density of the refrigerants in the working fluid at the inlet of the compressor 60

As noted above, the condenser 70 is disposed downstream of the compressor 60 and flash tank 42 and thus receives and cools the pressurized gas stream 36 to generate a predominantly liquid multiphase working fluid stream 37 that is then directed to the primary inlet 54 of the ejector component 50. Thus, the stream that enters the condenser 70 at a condenser inlet 72 may be 100% vapor or may be a blended stream of high-pressure vapor and liquid. The fluid stream entering the condenser inlet 72 of the condenser 70 is processed by the compressor 60, so it enters the condenser 70 as superheated vapor.

In the condenser 70, pressurized gas stream 36 transforms from a high-pressure vapor phase to a predominantly liquid phase (for example, first refrigerant (A) transforms from vapor to liquid). In the condenser 70, the working fluid is cooled by condensing that expels heat from the climate control system 20, as shown by the arrows reflecting airflow driven by a fan 74. The condenser 70 may be located in a space where heat may be expelled, for example, outdoors. As noted above, one aspect of the present technology is that the working fluid having the refrigerant blend with first refrigerant (A) and second refrigerant (B) may be only partially condensed to form a multiphase mixture of both liquid and optionally gas/vapor.

The working fluid exiting the condenser 70 at point 37 may thus comprise both first refrigerant (A) and second refrigerant (B) that are partially or fully in liquid phase. The working fluid condensate at point 37 is then circulated in fluid conduit 22 to the primary inlet 54 of the ejector component 50 and serves as the high-pressure motive or driving fluid stream that draws in the multiphase gas stream 30 from the evaporator 40 and mixes these multiphasic streams together as they exit outlet 59 of the ejector component 50. This multiphasic stream is then delivered to the flash tank 42 where it can be separated into a predominantly vapor/gas stream 32 and liquid stream 34, as previously described above.

The liquid stream 34 from the flash tank 42 passes into an expansion device, such as an expansion valve 80. At the expansion valve 80, pressure of the working fluid at point 38 is reduced. This reduced-pressure fluid predominantly containing liquid then enters an inlet 44 of the evaporator 40, so completing the refrigerant cycle. Thus, the stream that enters the evaporator 40 at the inlet 44 may be 100% liquid or may be a blended stream of low-pressure liquid and vapor. As will be appreciated by those of skill in the art, conventional components used with the climate control system 20 may not be shown, including flow rate, temperature, and pressure monitors, actuators, valves, controllers, computer processing units, and the like.

FIG. 2 shows another embodiment of a climate control system in the form of a reversible heat pump system 100. In a first operational mode, flow is directed in select parts of the system so that the heat pump system 100 serves to cool a target environment (e.g., indoor environment). In a second operational mode, flow is reversed in select parts of the system so that the heat pump system 100 serves to heat a target environment (e.g., indoor environment). Portions of the heat pump system 100 may thus be located indoors or in confined spaces like rooms, corresponding to the target environment, while the remaining portions of the heat pump system 100 may be located outdoors.

The reversible heat pump system 100 includes a reversible heat exchange assembly 102. The reversible heat exchange assembly 102 may include a first heat exchanger 110, a second heat exchanger 120, a first four-way valve 130, and a second four-way valve 132 that cooperate together and provide the ability to reverse flow of the working fluid in the reversible heat exchange assembly 102 and thus transition from the first operational mode (cooling mode) to the second operational mode (heating mode). In this configuration, the dual four-way valves 130, 132 enable a direction of working fluid flow through all parts in the climate control/reversible heat pump system 100 to remain the same in both heating and cooling modes, which is an important advantage for counterflow in heat exchangers when working fluids comprises refrigerants that have moderate to high glide.

The first heat exchanger 110 is disposed outdoors and may be operated as a condenser in the first operational mode (where cooling of the interior environment is achieved) or as an evaporator in the second operational mode or heating mode (where the interior environment is heated). The first heat exchanger 110 disposed outdoors includes a fan 112 and a coil 114. The first heat exchanger 110 is commonly referred to as an outdoor unit of the heat pump 100 and circulates ambient air (driven by the fan 112) across the internal coils 114 as shown by way of example by the arrows and generates exhaust.

The second heat exchanger 120 is commonly referred to as an air-handling unit of the heat pump 100 that provides a supply side and a return side for processing air for an indoor environment. The second heat exchanger 120 likewise may include a fan 122 and a coil 124. The second heat exchanger 120 is disposed indoors and may be operated as an evaporator in the first operational mode or cooling mode or a condenser in the second operational mode or heating mode. Depending on the operational mode, the supply air is driven by fan 122 and thus passes over the coil 124 (shown by the arrows in a countercurrent direction, although concurrent flow may also occur) where it may be either heated or cooled.

The reversible heat pump system 100 includes a gas-liquid/liquid-vapor separating vessel or flash tank 140. Upstream of the flash tank 140 is an ejector component 150. Both the flash tank 140 and ejector component 150 may have similar designs and operate in a similar manner to the flash tank 42 and ejector component 50 described above in the context of FIG. 1. Prior to entering the flash tank 140 and after exiting the ejector component 150, the working fluid may be a multiphase composition that comprises a combination of both first refrigerant (A) (e.g., $CO_2$) and second refrigerant (B) (e.g., R1233zd) that are partially or fully in gas phase. As noted above, one aspect of the present technology is that the working fluid having the refrigerant blend with first refrigerant (A) and second refrigerant (B) is only partially evaporated to form a mixture of both gas/vapor and liquid. The presence of the gas-liquid separator (e.g., flash tank 140) in the heat pump system 100 provides an ability to control how much of a temperature range for the refrigerant blend is being used. Further, the flash tank 140 also provides excess storage capacity for refrigerant/working fluid, as needed.

By way of example, the vapor quality, or mass fraction of vapor in the working fluid that exits the ejector component 150 may be predetermined to be any amount, for example from greater than or equal to about 15% to about 65% vapor quality, by way of non-limiting example, depending on an amount of liquid evaporated. In certain aspects, like in the embodiments described above, the flash tank 140 may have excess capacity for storage of additional refrigerant or may be associated with an ancillary storage tank. Thus, the flash tank 140 may store a fractionated blend of the working fluid. Prior to entering the flash tank 140, in one non-limiting example, an amount of $CO_2$ in the working fluid may be about 10%%. A relatively low amount of the first refrigerant (e.g., $CO_2$) can help optimize efficiency of the ejector cycle.

After the working fluid passes into the gas-liquid separation vessel or flash tank 140 that receives the working fluid and generates a vapor stream 170 and a liquid stream 171, like those discussed previously above. The vapor stream 170 may have about 15% of $CO_2$. The vapor stream 170 passes into a compressor 180 where it is compressed to increase pressure and form a high-pressure vapor or gas stream 172 exiting the compressor 180. The high-pressure gas stream 172 exiting the compressor 180 has a pressure that is significantly greater than the pressure of vapor stream 170. Further, the high-pressure gas stream 172 may have about 25% of $CO_2$.

The liquid stream 171 from the flash tank 140 may have about 1% $CO_2$. The liquid stream 171 from the flash tank 140 passes into an expansion valve 182 where pressure of the working fluid is reduced. This forms a first stream at point 173 having low vapor quality/predominantly liquid working fluid that enters a reversible heat exchange assembly 102. More specifically, the working fluid enters into the reversible heat exchange assembly 102 by passing through the first dual four-way valve 130.

In the first operational mode, the working fluid at point 173 delivered from the expansion valve 182 predominantly comprises liquid that passes through one side of the first dual four-way valve 130 into an inlet 126 of the second heat exchanger 120 inlet serving as an evaporator in the first operational mode, which is circulated therethrough and exits the evaporator 120 at outlet 128 being transformed from a liquid phase (or low quality vapor phase) to a gas or vapor phase at point 174, where the cooling effect of endothermic energy absorption occurs. A fan 122 facilitates airflow through the second heat exchanger/evaporator 120 as shown by arrows, where the passing air is cooled. Notably ambient air may enter the second heat exchanger 120 in one non-limiting example at about 35° F. and exit after passing over the coil 124 at about 20° F. Meanwhile, the working fluid circulating in the coil 124 at may be about 17° F. at the inlet 126 of the second heat exchanger 120 and about 24° F. as it exits outlet 128 of the second heat exchanger 120. The amount of $CO_2$ in the working fluid may be about 1%.

Next, the working fluid passes through one side of the second dual four-way valve 132 and is directed to a secondary inlet 152 of the ejector component 150.

With renewed reference to high-pressure gas stream 172 exiting the compressor 180, it enters the reversible heat exchange assembly 102 and is directed to a second side of the first dual four-way valve 130, where the working fluid is then routed to an inlet 116 of the first heat exchanger 110. The first heat exchanger 110 is thus disposed downstream of the compressor 180 and thus receives and cools the pressurized stream 172 to generate a condensed multiphase working fluid stream at point 175. By way of example, the vapor quality, or mass fraction of vapor of the working fluid that enters the first heat exchanger/condenser 110 may be superheated vapor. After exiting the outlet 118 of the first heat exchanger 110, the working fluid passes through a second side of the second dual four-way valve 132 and is directed to a primary inlet 152 of the ejector component 150.

The high-pressure condensed working fluid stream at point 175 exiting the first heat exchanger 110 and the high vapor quality working fluid stream at point 174 exiting the second heat exchanger 120 are combined and processed in the ejector component 150. After exiting the ejector component 150, the working fluid passes into the flash tank 140. Prior to entering the flash tank 140, as noted above, the working fluid may be a multiphase composition that comprises a combination of both first refrigerant (A) (e.g., $CO_2$) and second refrigerant (B) (e.g., R1233zd) that are partially in gas phase. The gas-liquid separator (e.g., flash tank 140) disposed in the heat pump system 100 provides an ability to control how much of a temperature range for the refrigerant blend is being used. By way of example, the vapor quality, or mass fraction of vapor of the working fluid at point 174 that exits the second heat exchanger 120 serving as an evaporator may be predetermined to be any amount, for example from greater than or equal to about 15% to about 100% vapor quality, by way of non-limiting example, depending on an amount of liquid evaporated. In certain aspects, like in the embodiments described above, the flash tank 140 may have excess capacity for storage of additional refrigerant or may be associated with an ancillary storage tank. Thus, the flash tank 140 may store a fractionated blend of the working fluid. Prior to entering the flash tank 140, in one non-limiting example, an amount of $CO_2$ in the working fluid may be about 10%.

The concentration of first refrigerant (A) and second refrigerant (B) may be varied by injecting and combining different amounts of stored low-pressure refrigerant (refrigerant (B) here R1233zd) in the liquid stream at point 171 with vapor stream 170/high-pressure gas stream 172 that are eventually combined in the ejector component 150, where they may be separated and/or stored in the flash tank 140.

The reversible heat exchange assembly 102 is configured to receive the same input/feed streams and provide the same output streams no matter which mode of operation is selected, while providing the ability to reverse flow of the working fluid internally depending on the mode of operation of the reversible heat pump system 100. In this way, the first heat exchanger is located in the target environment and may be cooled in the first operational mode or heated in the second operational mode when flow is reversed in the reversible heat exchange assembly 102.

Thus, the reversible heat exchange assembly 102 is disposed downstream of the compressor 180. The reversible heat exchange assembly 102 thus receives the pressurized high-pressure gas/vapor stream 172 from the compressor 180 and the reduced pressure liquid stream 173 from the expansion device 182. After being processed in the reversible heat exchange assembly 102 as described above, a first multiphase or liquid condensed working fluid stream 175 and a second multiphase or vapor working fluid stream 174 exit the reversible heat exchange assembly 102. These are fed to the ejector component 150.

As will be appreciated by those of skill in the art, in a second operational (heating) mode, the flow of the working fluid is modified (e.g., reversed) in parts of the fluid conduit 134 within the reversible heat exchange assembly 102 so that the first heat exchanger 110 instead operates as an evaporator and the second heat exchanger 120 operates as a condenser. Thus, the reduced pressure liquid stream 173 exiting from the expansion valve 182 enters into the reversible heat exchange assembly 102 by passing through the first dual four-way valve 130, but now passes into the first heat exchanger 110, where it is evaporated. This forms the high vapor quality working fluid stream that passes through the second dual four-way valve 132 at point 175 and then is delivered to the secondary inlet 152 of the ejector component 150. Likewise, the high-pressure vapor or gas stream 172 is directed through the other side of the first dual four-way valve 130 and is now delivered to the second heat exchanger 120 that serves as a condenser to release heat to the interior target environment. After exiting the second heat exchanger 120, the stream is processed in the second dual four-way valve 132, where it is routed as high-pressure condensed working fluid stream 174 that enters the primary inlet 154 of the ejector component 150. In this manner, the flow of the working fluid within the reversible heat exchange assembly 102 may be reversed, while the direction of flow of working fluid in the remaining portions of the reversible heat pump system 100 advantageously remain the same.

Those of skill in the art will also appreciate that conventional components used with the reversible heat pump system 100 may not be shown, including flow rate, temperature, and pressure monitors, actuators, valves, controllers and the like.

In FIG. 3, a climate control system in the form of a reversible heat pump system 100A is shown that processes and circulates a working fluid having a composition comprising first refrigerant (A) and second refrigerant (B) with a similar system to those described in the context of FIG. 2. To the extent that the components are similar to those described in FIG. 2, the same reference numbers will be used and unless otherwise addressed, for brevity, will not be discussed again herein. As will be appreciated by those of skill in the art, any of the features and components described in the context of FIG. 3 may be used individually or in combination in the climate control systems described in the context of FIG. 1 or 2, as well. In the first operational mode, high-pressure working fluid enters the inlet 116 of a first heat exchanger 110 serving as a condenser in the first operational mode, where first refrigerant (A) and second refrigerant (B) may transform from a gas or vapor phase to a high-pressure fluid that is primarily liquid upon exiting at outlet 118 of the first heat exchanger 110. In the reversible heat pump system 100A in FIG. 3, the working fluid exiting the first heat exchanger 110 operating as a condenser then enters a third heat exchanger 190 on a first side 192.

Likewise, a reduced pressure liquid-containing stream 173 is generated after passing through expansion valve 82, which enters an inlet 126 of the second heat exchanger 120 serving as an evaporator in the first operational mode and passes through coil 124. The working fluid comprising first refrigerant (A) and second refrigerant (B) may transform from a primarily liquid phase to a gas or vapor phase when it passes through the second heat exchanger 120 serving as an evaporator in the first operational mode. Thus, a low-pres sure multiphase working fluid with a higher vapor quality than at the inlet 126 exits an outlet 128 of the second heat exchanger 120 and then enters a second side 194 of the third heat exchanger 190.

Generally, the third heat exchanger 190 transfers heat between the relatively hot condensate liquid exiting the first heat exchanger 110 serving as condenser passing through the first side 192 and colder higher vapor quality fluid exiting the second heat exchanger 120 serving as evaporator passing through the second side 194. More specifically, the hotter condensate liquid can increase the temperature and vapor quality from the evaporator in the heat exchanger to provide a higher level of sub-cooling or a lower temperature and lower vapor quality of the condensate effluent to increase the evaporator capacity. Thus, the third exchanger 190 can provide certain advantages in the reversible heat pump system 100A, including further cooling the liquid refrigerant prior to it entering ejector 150 that enters and is separated in the flash tank 140, which can increase system efficiency. In this manner, the partially evaporated refrigerant is further evaporated by heat transfer with slightly warmer partially condensed (or performs subcooling of) refrigerant from the same cycle. Further, the third heat exchanger 190 does not superheat the suction gas.

Notably, any of the design configurations described above in the context of evaporators or condensers for countercurrent heat exchange are suitable for use as the third heat exchanger 190. Thus, as described above, the first side 192 of the third heat exchanger 190 (that receives working fluid exiting the first heat exchanger 110 serving as the condenser that may thus comprise both first refrigerant (A) and second refrigerant (B) that are partially or fully in liquid phase) is in heat exchange relationship with the second side 194 (that receives the multiphase working fluid exiting the second heat exchanger 120 (evaporator)). Thus, a condensed working fluid at point 177 passes on the first side 192 and transfers heat to the partially evaporated stream 179 leaving the second heat exchanger 120 (evaporator) on the second side 194 of third heat exchanger 190. After passing through the first side 192 of the third heat exchanger 190, the condensate liquid working fluid then passes through first four-way valve 132 and is directed to a primary inlet 154 of the ejector component 150. After passing through the second side 194 of the third heat exchanger 190, the multiphase working fluid exits and then passes into the first four-way valve 132 and is directed towards secondary inlet 152 of the ejector 150. Downstream of the ejector component 150, the multiphase working stream enters the flash tank 140, where it is separated into first vapor stream 170 and second liquid stream 171. The first vapor stream 170 is directed toward compressor 180 and the second liquid stream 171 is directed towards the expansion valve 182. In certain aspects, a balance of refrigerant charge in the system can be modified by operating with less subcooling at the outlet on the first side 192 of the third heat exchanger 190.

In certain aspects, an amount of heat transferred by the third heat exchanger 190 is expressed by a difference in temperature ($\Delta T$) between a first temperature ($T_1$) of the working fluid at point 177 and a second temperature ($T_2$) of the working fluid at point 179. As will be appreciated by those of skill in the art, a temperature difference ($\Delta T$) generally will depend on the application and operating conditions of the system. In certain variations, a difference between the first temperature ($T_1$) at point 177 and the second temperature ($T_2$) at point 179 may be greater than or equal to about 5° C. (where the second temperature $T_2$ is at least about 5° C. below the first temperature $T_1$), optionally greater than or equal to about 10° C., optionally greater than or equal to about 15° C., optionally greater than or equal to about 20° C., optionally greater than or equal to about 30° C., optionally greater than or equal to about 40° C., optionally greater than or equal to about 50° C., optionally greater than or equal to about 60° C., optionally greater than or equal to about 70° C., optionally greater than or equal to about 80° C., optionally greater than or equal to about 90° C., and in certain variations, optionally greater than or equal to about 100° C.

In various aspects, control of the climate control systems, including reversible heat pump systems, described in any of the embodiments above may be achieved by a control module. In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects.

The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C #, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

In various aspects, the control module can be used to activate, deactivate, or modulate operation of various components and devices in the climate control system, including compressor(s), fan(s), pump(s), valve(s), and the like. The control module may receive input from various sensors in the climate control system, such as temperature sensors, pressure sensors, flow rate sensors, current and voltage meters, etc. The sensors provide measurements from which a control module can determine necessary modifications to the climate control system.

The control module can include one or more modules and can be implemented as part of a control board, furnace board, thermostat, air handler board, contactor, or other form of control system or diagnostic system. The control module can contain power conditioning circuitry to supply power to various components using 24 Volts (V) alternating current (AC), 120V to 240V AC, 5V direct current (DC) power, etc. The control module can include bidirectional communication which can be wired, wireless, or both whereby system debugging, programming, updating, monitoring, parameter value/state transmission etc. can occur. Climate control systems can more generally be referred to as air conditioning or refrigeration systems.

Thus, a control module may open, close, regulate, or direct working fluid flow (or portions of working fluid flow, such as first refrigerant and/or second refrigerant) into and out of various components and devices in the system via the conduits, including in the evaporator, condenser, expansion valve, gas-liquid separator, heat exchangers, storage vessels, and the like.

In various aspects, the present disclosure also contemplates methods for operating a climate control system that circulates a working fluid comprising a refrigerant blend having moderate to high glide in the systems discussed above. One variation of such a method may comprise pressurizing a working fluid vapor by passing it through a compressor in a fluid conduit. The working fluid comprises the refrigerant blend that comprises a first refrigerant and a second refrigerant, where a difference in boiling points between the first refrigerant and the second refrigerant is greater than or equal to about 10° F. at atmospheric pressure or any of the differences described above. The method also comprises condensing at least a portion of the working fluid in a first heat exchanger disposed downstream of the compressor to form a condensed stream that is delivered to a primary inlet of an ejector component. Further, at least a portion of the working fluid in a second heat exchanger may be evaporated to form a vaporized stream that is delivered to a secondary inlet of the ejector component. The condensed stream and the vaporized stream may be directed to and mixed in an ejector component, like any of those described above, to form a mixed stream that exits the ejector component. The method may also comprise passing the mixed stream into a gas-liquid separation vessel disposed downstream of the ejector component and upstream of the compressor and upstream of an expansion device. The method may include separating the working fluid into a vapor stream, which is directed to the compressor, and a liquid stream, which is directed towards the expansion device. The method may also comprise reducing pressure of the working fluid by passing through the expansion device and delivering it to the second heat exchanger.

In certain variations, the condensing only partially condenses the working fluid to a liquid phase and the evaporating only partially evaporates the working fluid to a vapor phase.

The methods may further comprise storing a portion of the first refrigerant and/or the second refrigerant in the gas-liquid separation vessel to modulate cooling (or heating) capacity of the climate control system. Thus, in certain other aspects, the storage vessel may be the gas-liquid separation vessel (such as flash tank 42 in FIG. 1 or flash tank 140 in FIGS. 2 and 3) that is downstream of the ejector component. Thus, the gas-liquid separator tank/flash tank may have excess capacity for storage of additional refrigerant or may be associated with an ancillary storage tank. In this manner, the method may include storing one or more of the first refrigerant or the second refrigerant in the gas-liquid separation vessel to balance the refrigerant in the climate control system. For example, the method may include raising a downstream level of one or both of the first refrigerant and/or second refrigerant to counter the effects of a lower upstream level of first refrigerant and/or second refrigerant.

The methods may further comprise circulating air through the first heat exchanger (e.g., evaporator) and the second heat exchanger (e.g., condenser) in a heat transfer relationship with the fluid conduit to transfer heat to the working fluid (e.g., prior to entering the evaporator). In certain aspects, a first temperature range of the refrigerant blend is operated to be greater than or equal to about 50% to less than or equal to about 200%, optionally greater than or equal to about 66% to less than or equal to about 150% of a second temperature range of the air.

In other aspects, a first temperature range of the refrigerant blend is operated to be greater than or equal to about 66% to less than or equal to about 150% of a second temperature range of air in the first heat exchanger or the second heat exchanger.

In yet other aspects, the fluid conduit further comprises a third heat exchanger disposed downstream of the first heat exchanger and downstream of the second heat exchanger. The method further comprises passing the working fluid stream from the first heat exchanger through a first side of the third heat exchanger in a first flow direction and directing it to the ejector component. The method also comprises passing the low-pres sure working fluid stream from the second heat exchanger in a second flow direction opposite to the first flow direction to transfer heat therebetween and directing it to the ejector component.

In certain aspects, the first refrigerant and the second refrigerant are independently selected from the group consisting of: carbon dioxide (R-744), 1,1,1,2-tetrafluoroethane (R134A), R410A (a near-azeotropic mixture of difluoromethane (R-32) and pentafluoroethane (R-125), dimethyl ether (R-E170), propane (R-290), 2,3,3,3,-tetrafluoroprop-1-ene (R-1234yf), cis- and trans-1,3,3,3,-tetrafluoropropene (HFO-1234ye), cis- and trans-1,3,3,3,-tetrafluoroprop-1-ene (R-1234ze), 3,3,3,-trifluoropropene (HFO-1234zf), trifluoro, monochloropropenes (HFO-1233), trans-1-chloro-3,3,3-trifluoropropene (HFO-1233zd(E)), cis-1-chloro-3,3,3-trifluoropropene (HFO-1233zd(Z)), 2-chloro-3,3,3-trifluoropropene (HFO-1233xf), trans-1,1,1,4,4,4-hexafluoro-2-butene (HFO-1336mzz(Z)), cis-1,1,1,4,4,4-hexafluoro-2-butene (HFO-1336mzz(E)), pentafluoropropenes (HFO-1225), 1,1,3,3,3-pentafluoropropene (HFO-1225zc), 1,2,3,3,3-pentafluoropropene (HFO-1225yez), hexafluorobutenes (HFO-1336), cis-1,1,1,4,4,4-hexafluoro-2-butene (HFO-1336mzz(Z)), trans-1,1,1,4,4,4-hexafluoro-2-butene (R1336mzz(E)), trans-1,2-difluoroethene (R-1132(E)), and any isomers or combinations thereof.

In certain aspects, the condensing comprises partially condensing a portion of the working fluid in the first heat exchanger disposed downstream of the compressor to form the condensed stream as a multiphasic condensed stream that is directed to a primary inlet of the ejector component. Further, the method may also comprise partially evaporating a portion of the working fluid in a second heat exchanger disposed downstream of the expansion device to form the vaporized stream as a multiphasic vaporized stream that is directed to a secondary inlet of the ejector component. In certain variations, the working fluid comprises the refrigerant blend having high glide that comprises a first refrigerant and a second refrigerant, wherein a difference in boiling points between the first refrigerant and the second refrigerant is greater than or equal to about 25° F. at atmospheric pressure.

In one variation, the climate control systems of the present disclosure can process a working fluid comprising a first refrigerant and a second refrigerant having a moderately high glide refrigerant, meaning a difference in boiling points between the first refrigerant and the second refrigerant is greater than or equal to about 10° F. at atmospheric pressure or any of the differences described above. The amount of glide/difference in boiling points may be as large as a temperature range on the airside of the climate control system. Further, by operating the ejector component to drive two-phase refrigerant leaving the condenser allows a lower charge of refrigerant and allows the refrigerant glide to be matched to the air temperature range.

In another variation, the climate control systems of the present disclosure can process a working fluid comprising a first refrigerant and a second refrigerant having a high to extremely high glide refrigerant, meaning a difference in boiling points between the first refrigerant and the second refrigerant is greater than or equal to about 25° F. at atmospheric pressure or any of the differences described above. For example, the working fluid having high glide may comprise a mixture of a first refrigerant (A) (e.g., $CO_2$) and second refrigerant (B) (e.g., R1234ze, R1233zd). Only a small portion of the phase change is performed in each of the first and second heat exchangers and the ejector component captures the energy lost from expanding the high vapor quality refrigerant.

In both of the variations (moderate and high glide refrigerant blends) described just above, there can be fractionation in the flash tank that would result in different fluid blends in the evaporator than would be present in the compressor and condenser.

Additionally, it is possible to permit some gas/vapor from the gas-liquid separator/flash tank to enter the evaporator in the liquid stream (as a multiphasic stream), which creates additional flexibility for operating the climate control system.

Moreover, the climate control systems prepared in accordance with certain aspects of the present technology can take full advantage of the glide of a refrigerant blend comprising a first refrigerant (A) and second refrigerant (B) by operating the evaporator and condenser in counterflow in both heating and cooling modes.

In certain aspects, the climate control systems that incorporate ejector components in accordance with the present teachings provide certain advantages. By way of non-limiting example, a climate control system incorporating an ejector component as described above provide an ability to use variable refrigerants while minimizing the penalties for high glide mixtures. This creates opportunities for new refrigerant blends that would not otherwise be considered or feasible.

Further, in certain aspects, rather than necessitating use of a mechanically adjustable variable ejector, a concentration of a first refrigerant and/or a second refrigerant in the working fluid in the system can be used to tune the refrigerant(s) to match the nozzle and post-nozzle dimensions of the ejector component.

Moreover, the gas-liquid separator/flash tank incorporated into the climate control systems according to certain aspects of the present disclosure can be used to change a concentration of a particular refrigerant in the refrigerant blend by changing an amount of liquid in the flash tank, where the evaporator and condenser in the ejector cycle have different refrigerant concentrations.

In certain other aspects, a refrigerant blend may include a first refrigerant that is an A1 refrigerant such as $CO_2$ mixed with a second refrigerant, such as R1234ze or R1233zd, or that may be a flammable refrigerant (such as an ASHRAE 34 class A3), like dimethyl ether. In this variation where the second refrigerant is flammable, the system maintains a ratio of the relatively inert first refrigerant (e.g., A1 refrigerant) to limit an amount of the second flammable refrigerant on the indoor side of the system to a safe level. Further, the climate control system could have an indoor portion and an outdoor portion that may be isolated from one another, such as is described in co-owned U.S. patent application Ser. No. 17/019,946 filed Sep. 14, 2020, entitled Refrigerant Isolation Using a Reversing Valve, the relevant portions of which are incorporated by reference. In other aspects, the present disclosure may contemplate a method of calculating an amount of the second flammable refrigerant component of a binary mixture of the first and second refrigerant on the indoors, for example, as described in co-owned U.S. patent application Ser. No. 16/940,843 filed on Jul. 28, 2020 and entitled "Refrigerant Leak Detection," the relevant portions of which are incorporated by reference, where charge can be calculated by using the proportional relationship between enthalpy and specific volume of a refrigerants, but employs more than the four described measurements.

Further, the cycle could allow some limited variation in refrigerant concentration by allowing storage in a section of the system or could maintain the same concentrations through all conditions to maintain the same safe level of flammable refrigerant from the baseline operating condition.

Certain embodiments of the inventive technology can be further understood by the specific example contained herein. Specific Examples are provided for illustrative purposes of how to make and use the devices and methods according to the present teachings and, unless explicitly stated otherwise, are not intended to be a representation that given embodiments of this invention have, or have not, been made or tested.

Example

A non-limiting simulated operation example is provided herein to illustrate certain concepts of the present disclosure. A single refrigerant blend includes carbon dioxide (R744, the low boiling point, high-pressure first refrigerant) and difluoromethane (R32) (the high boiling point, low-pressure second refrigerant). As will be appreciated, this refrigerant blend is merely a non-limiting example of a single refrigerant blend; however, additional blends may be used and tailored to certain desired performance requirements. The evaporator inlet and outlet both have two-phase streams and represent only a portion of the temperature range in phase change.

One measure of system performance is an energy efficiency ratio (EER) gain or loss or a coefficient of performance (COP). COP is generally defined as the heating capacity of the system divided by the power input to the system and can be a useful measure of the compressor's performance. In various aspects, the performance of a compressor has a COP loss defined by $$\Delta COP\ (\%) = \frac{(COP_{initial} - COP_{final})}{COP_{initial}} \times 100,$$

where $COP_{initial}$ is an initial COP measured at the beginning of compressor operation and $COP_{final}$ is compressor performance at the end of a reliability test.

A first simulation of performance at AHRI 210/240 A conditions (with systems having cooling capacities of less than 65,000 BTU/h) with a blend of refrigerants comprising 40% carbon dioxide (CO2) and 60% difluoromethane (R32). At these conditions, the simulations results in a 14.7 EER.

A second set of simulations of performance at AHRI 210/240 B conditions with a blend of refrigerants comprising 55% carbon dioxide (CO2) and 45% difluoromethane (R32).

A fixed ejector design optimized for the flow conditions of SEER "A" point is used. At these conditions, the simulations result in a 17.7 EER. Another simulation is run with the fixed ejector designed for the SEER "B" point flow conditions. In this simulation, the EER is about 20.

In these simulations, the performance is better than azeotropic refrigerants in a standard cycle because the energy lost in expansion of a standard system is used to raise the suction pressure of the ejector cycle. Further, the temperature range of the air or other secondary fluid can be aligned to the temperature range of the refrigerant so that there is a smaller compression ratio at the saturated vapor pressure between evaporator and condenser.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A climate control system that circulates a working fluid comprising a refrigerant blend, the climate control system comprising:

the working fluid comprising a first refrigerant and a second refrigerant, wherein a difference in boiling points between the first refrigerant and the second refrigerant is greater than or equal to about 10° F. at atmospheric pressure;

a gas-liquid separation vessel that receives the working fluid and generates a vapor stream and a liquid stream;

a compressor that receives the vapor stream from the gas-liquid separation vessel and generates a pressurized vapor stream;

a first heat exchanger disposed downstream of the compressor that receives the pressurized vapor stream to generate a first multiphase or liquid working fluid stream;

an expansion device that receives the liquid stream from the gas-liquid separation vessel and generates a reduced pressure stream;

a second heat exchanger that receives the reduced pressure stream from the expansion device and at least partially vaporizes the reduced pressure stream to generate a second multiphase or vapor working fluid stream;

an ejector component disposed downstream of the first heat exchanger and the second heat exchanger that receives the first multiphase or liquid working fluid stream and the second multiphase or vapor working fluid stream to generate a third multiphase fluid stream that is directed to the gas-liquid separation vessel;

a third heat exchanger disposed downstream of the first heat exchanger and the second heat exchanger that is configured to receive the working fluid from the first heat exchanger in a first flow direction on a first side and direct it to the ejector component and configured to receive the working fluid from the second heat exchanger on a second side in a second flow direction that is opposite to the first flow direction and direct it to the ejector component; and a fluid conduit for circulating the working fluid and establishing fluid communication between the gas-liquid separation vessel, the compressor, the first heat exchanger, the expansion device, the second heat exchanger, and the ejector component through which the working fluid circulates.

2. The climate control system of claim 1, wherein the gas-liquid separation vessel has a volume with an excess capacity and is configured to selectively store at least a portion of the working fluid.

3. The climate control system of claim 1, wherein the first refrigerant comprises an ASHRAE class A1 or A2L refrigerant.

4. The climate control system of claim 1, wherein the first refrigerant and the second refrigerant are independently selected from the group consisting of: carbon dioxide (R-744), 1,1,1,2-tetrafluoroethane (R134A), R410A (a near-azeotropic mixture of difluoromethane (R-32) and pentafluoroethane (R-125), dimethyl ether (R-E170), propane (R-290), 2,3,3,3,-tetrafluoroprop-1-ene (R-1234yf), cis- and trans-1,3,3,3,-tetrafluoropropene (HFO-1234ye), cis- and trans-1,3,3,3,-tetrafluoroprop-1-ene (R-1234ze), 3,3,3,-trifluoropropene (HFO-1234zf), trifluoro, monochloropropenes (HFO-1233), trans-1-chloro-3,3,3-trifluoropropene (HFO-1233zd (E)), cis-1-chloro-3,3,3-trifluoropropene (HFO-1233zd (Z)), 2-chloro-3,3,3-trifluoropropene (HFO-1233xf), trans-1,1,1,4,4,4-hexafluoro-2-butene (HFO-1336mzz (Z)), cis-1,1,1,4,4,4-hexafluoro-2-butene (HFO-1336mzz (E)), pentafluoropropenes (HFO-1225), 1,1,3,3,3-pentafluoropropene (HFO-1225zc), 1,2,3,3,3-pentafluoropropene (HFO-1225yez), hexafluorobutenes (HFO-1336), cis-1,1,1,4,4,4-hexafluoro-2-butene (HFO-1336mzz (Z)), trans-1,1,1,4,4,4-hexafluoro-2-butene (R1336mzz (E)), trans-1,2-difluoroethene (R-1132 (E)), and any isomers or combinations thereof.

5. The climate control system of claim 1, wherein the working fluid further comprises a lubricant that is soluble with the first refrigerant and the climate control system further comprises an oil storage vessel or sump that stores at least a portion of the lubricant in the working fluid.

6. The climate control system of claim 1, further comprising a reversing valve or a pair of four way valves to enable the climate control system to conduct both heating and cooling.

7. The climate control system of claim 1, wherein the ejector component comprises a primary inlet that receives the first multiphase or liquid working fluid stream and a secondary inlet that receives the second multiphase or vapor working fluid stream and the ejector component generates the third multiphase fluid stream that is directed to the gas-liquid separation vessel.

8. The climate control system of claim 7, wherein the ejector component further comprises a converging nozzle, a mixing region downstream of the converging nozzle, and a diverging nozzle downstream of the mixing region.

9. A climate control reversible heat pump system that circulates a working fluid comprising a refrigerant blend, the climate control reversible heat pump system comprising:

the working fluid comprising a first refrigerant and a second refrigerant, wherein a difference in boiling points between the first refrigerant and the second refrigerant is greater than or equal to about 10° F. at atmospheric pressure;

a gas-liquid separation vessel that receives the working fluid and generates a vapor stream and a liquid stream;

a compressor that receives the vapor stream from the gas-liquid separation vessel and generates a pressurized vapor stream;

an expansion device that receives the liquid stream from the gas-liquid separation vessel and generates a reduced pressure stream;

a reversible heat exchange assembly disposed downstream of the compressor that receives the pressurized vapor stream from the compressor and the reduced pressure stream from the expansion device and generates a first multiphase or liquid working fluid stream and a second multiphase or vapor working fluid stream, the reversible heat exchange assembly comprising:

a first heat exchanger;

a first four-way valve disposed between the compressor and the first heat exchanger;

a second heat exchanger; and a second four-way valve disposed between the first heat exchanger and the second heat exchanger;

an ejector component comprising a primary inlet and a secondary inlet and that is disposed downstream of the reversible heat exchange assembly that receives the first multiphase or liquid working fluid stream in the primary inlet and the second multiphase or vapor working fluid stream in the secondary inlet to generate a third multiphase fluid stream that is directed to the gas-liquid separation vessel;

a third heat exchanger disposed downstream of the first heat exchanger and the second heat exchanger that is configured to receive the working fluid from the first heat exchanger in a first flow direction on a first side and direct it to the second four-way valve and the ejector component and configured to receive the working fluid from the second heat exchanger on a second side in a second flow direction that is opposite to the first flow direction and direct it to the second four-way valve and the ejector component; and a fluid conduit for circulating the working fluid and establishing fluid communication between the gas-liquid separation vessel, the compressor, reversible heat exchange assembly, the expansion device, and the ejector component through which the working fluid circulates.

10. The climate control reversible heat pump system of claim 9, wherein in a first operational mode the first heat exchanger is configured to receive the pressurized vapor stream to generate the first multiphase or liquid working fluid stream and the second heat exchanger is configured to receive and at least partially vaporize the reduced pressure stream from the expansion device to generate the second multiphase or vapor working fluid stream, while in a second operational mode, the first heat exchanger is configured to receive and at least partially vaporize the reduced pressure stream from the expansion device to generate the second multiphase or vapor working fluid stream and the second heat exchanger is configured to receive the pressurized vapor stream to generate the first multiphase or liquid working fluid stream.

11. The climate control reversible heat pump system of claim 9, wherein the gas-liquid separation vessel has a volume with an excess capacity and is configured to selectively store at least a portion of the working fluid.

12. The climate control reversible heat pump system of claim 9, wherein the first refrigerant and the second refrigerant are independently selected from the group consisting of: carbon dioxide (R-744), 1,1,1,2-tetrafluoroethane (R134A), R410A (a near-azeotropic mixture of difluoromethane (R-32) and pentafluoroethane (R-125), dimethyl ether (R-E170), propane (R-290), 2,3,3,3,-tetrafluoroprop-1-ene (R-1234yf), cis- and trans-1,3,3,3,-tetrafluoropropene (HFO-1234ye), cis- and trans-1,3,3,3,-tetrafluoroprop-1-ene (R-1234ze), 3,3,3,-trifluoropropene (HFO-1234zf), trifluoro,monochloropropenes (HFO-1233), trans-1-chloro-3,3,3-trifluoropropene (HFO-1233zd (E)), cis-1-chloro-3,3,3-trifluoropropene (HFO-1233zd (Z)), 2-chloro-3,3,3-trifluoropropene (HFO-1233xf), trans-1,1,1,4,4,4-hexafluoro-2-butene (HFO-1336mzz (Z)), cis-1,1,1,4,4,4-hexafluoro-2-butene (HFO-1336mzz (E)), pentafluoropropenes (HFO-1225), 1,1,3,3,3-pentafluoropropene (HFO-1225zc), 1,2,3,3,3-pentafluoropropene (HFO-1225yez), hexafluorobutenes (HFO-1336), cis-1,1,1,4,4,4-hexafluoro-2-butene (HFO-1336mzz (Z)), trans-1,1,1,4,4,4-hexafluoro-2-butene (R1336mzz (E)), trans-1,2-difluoroethene (R-1132 (E)), and any isomers or combinations thereof.

13. A method for operating a climate control system that circulates a working fluid comprising a refrigerant blend, the method comprising:

pressurizing a working fluid vapor by passing it through a compressor in a fluid conduit, wherein the working fluid comprises the refrigerant blend that comprises a first refrigerant and a second refrigerant, wherein a difference in boiling points between the first refrigerant and the second refrigerant is greater than or equal to about 10° F. at atmospheric pressure;

condensing at least a portion of the working fluid in a first heat exchanger disposed downstream of the compressor to form a condensed stream that is delivered to a primary inlet of an ejector component;

evaporating at least a portion of the working fluid in a second heat exchanger to form a vaporized stream that is delivered to a secondary inlet of the ejector component;

mixing the condensed stream and the vaporized stream in the ejector component to form a mixed stream that exits the ejector component;

passing the mixed stream into a gas-liquid separation vessel disposed downstream of the ejector component and upstream of the compressor and an expansion device that separates the working fluid into a vapor stream that is directed to the compressor and a liquid stream that is directed towards the expansion device; and reducing pressure of the working fluid by passing through the expansion device and delivering it to the second heat exchanger, wherein the fluid conduit further comprises a third heat exchanger disposed downstream of the first heat exchanger and downstream of the second heat exchanger, wherein the method further comprises passing the working fluid from the first heat exchanger through a first side of the third heat exchanger in a first flow direction and directing it to the ejector component and passing the working fluid from the second heat exchanger in a second flow direction opposite to the first flow direction to transfer heat therebetween and direct it to the ejector component.

14. The method of claim 13, wherein the method comprises further comprising storing a portion of the first refrigerant and/or the second refrigerant in the gas-liquid separation vessel to modulate cooling capacity of the climate control system.

15. The method of claim 13, wherein a first temperature range of the refrigerant blend in the first heat exchanger is operated to be greater than or equal to about 66% to less than or equal to about 150% of a second temperature range of air in the first heat exchanger or the second heat exchanger.

16. The method of claim 13, wherein the first refrigerant and the second refrigerant are independently selected from the group consisting of: carbon dioxide (R-744), 1,1,1,2-tetrafluoroethane (R134A), R410A (a near-azeotropic mixture of difluoromethane (R-32) and pentafluoroethane (R-125), dimethyl ether (R-E170), propane (R-290), 2,3,3,3,-tetrafluoroprop-1-ene (R-1234yf), cis- and trans-1,3,3,3,-tetrafluoropropene (HFO-1234ye), cis- and trans-1,3,3,3,-tetrafluoroprop-1-ene (R-1234ze), 3,3,3,-trifluoropropene (HFO-1234zf), trifluoro, monochloropropenes (HFO-1233), trans-1-chloro-3,3,3-trifluoropropene (HFO-1233zd (E)), cis-1-chloro-3,3,3-trifluoropropene (HFO-1233zd (Z)), 2-chloro-3,3,3-trifluoropropene (HFO-1233xf), trans-1,1,1,4,4,4-hexafluoro-2-butene (HFO-1336mzz (Z)), cis-1,1,1,4,4,4-hexafluoro-2-butene (HFO-1336mzz (E)), pentafluoropropenes (HFO-1225), 1,1,3,3,3-pentafluoropropene (HFO-1225zc), 1,2,3,3,3-pentafluoropropene (HFO-1225yez), hexafluorobutenes (HFO-1336), cis-1,1,1,4,4,4-hexafluoro-2-butene (HFO-1336mzz (Z)), trans-1,1,1,4,4,4-hexafluoro-2-butene (R1336mzz (E)), trans-1,2-difluoroethene (R-1132 (E)), and any isomers or combinations thereof.

17. The method of claim 13, wherein the condensing comprises partially condensing a portion of the working fluid in the first heat exchanger disposed downstream of the compressor to form the condensed stream as a multiphase condensed stream that is directed to the primary inlet of the ejector component; and partially evaporating a portion of the working fluid in the second heat exchanger disposed downstream of the expansion device to form the vaporized stream as a multiphase vaporized stream that is directed to the secondary inlet of the ejector component, wherein the working fluid comprises the refrigerant blend that comprises a first refrigerant and a second refrigerant, wherein a difference in boiling points between the first refrigerant and the second refrigerant is greater than or equal to about 25° F. at atmospheric pressure.

* * * * *